US011796928B2

(12) United States Patent
Shingu et al.

(10) Patent No.: US 11,796,928 B2
(45) Date of Patent: Oct. 24, 2023

(54) ELECTROPHOTOGRAPHIC PHOTOSENSITIVE MEMBER, PROCESS CARTRIDGE, AND IMAGE FORMING APPARATUS

(71) Applicant: FUJIFILM Business Innovation Corp., Tokyo (JP)

(72) Inventors: Kenta Shingu, Kanagawa (JP); Yoshiteru Yamada, Kanagawa (JP); Akihiro Kawasaki, Kanagawa (JP); Keisuke Kusano, Kanagawa (JP); Kohei Hashimoto, Kanagawa (JP); Yuto Okazaki, Kanagawa (JP); Takeshi Iwanaga, Kanagawa (JP); Wataru Yamada, Kanagawa (JP); Hirohito Yoneyama, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 188 days.

(21) Appl. No.: 17/396,061

(22) Filed: Aug. 6, 2021

(65) Prior Publication Data

US 2022/0308473 A1 Sep. 29, 2022

(30) Foreign Application Priority Data

Mar. 26, 2021 (JP) ..... 2021-054289

(51) Int. Cl.

| | |
|---|---|
| ***G03G 5/06*** | (2006.01) |
| ***G03G 5/05*** | (2006.01) |
| ***G03G 21/18*** | (2006.01) |

(52) U.S. Cl.

CPC ..... *G03G 5/0539* (2013.01); *G03G 5/0672* (2013.01); *G03G 5/06144* (2020.05); *G03G 21/1803* (2013.01)

(58) Field of Classification Search

CPC ..... G03G 5/06147; G03G 5/061443; G03G 5/0589; G03G 5/0539

See application file for complete search history.

(56) References Cited

U.S. PATENT DOCUMENTS

2013/0209929 A1* 8/2013 Fujii ..... G03G 5/06142 430/58.75
2020/0257212 A1* 8/2020 Iwasaki ..... C08F 290/062

FOREIGN PATENT DOCUMENTS

| | | | |
|---|---|---|---|
| JP | 2001-305761 | A | 11/2001 |
| JP | 2005-326474 | A | 11/2005 |
| JP | 6447200 | B2 | 1/2019 |

* cited by examiner

*Primary Examiner* — Peter L Vajda
(74) *Attorney, Agent, or Firm* — Sughrue Mion, PLLC

(57) ABSTRACT

An electrophotographic photosensitive member includes a conductive support and a photosensitive layer disposed on the conductive support. A top surface layer of the electrophotographic photosensitive member includes fluorine-containing resin particles, a fluorine-containing dispersant, and two or more charge transporting materials. When the charge transporting materials are listed in order of decreasing HOMO energy levels, a difference in HOMO energy level between each adjacent two of the charge The ratio A of the amount of each of the charge transporting materials to the total amount of the charge transporting materials satisfies the condition 1 below, $$[(100/N)-(100/N\times0.3)]\leq A\leq[(100/N)+(100/N\times0.3)] \quad \text{Condition 1}$$

where N represents the number of types of the charge transporting materials included in the top surface layer.

18 Claims, 3 Drawing Sheets

ELECTROPHOTOGRAPHIC PHOTOSENSITIVE MEMBER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2021-054289 filed Mar. 26, 2021.

BACKGROUND

(i) Technical Field

The present disclosure relates to an electrophotographic photosensitive member, a process cartridge, and an image forming apparatus.

(ii) Related Art

Japanese Patent No. 6447200 discloses an electrophotographic photosensitive member that includes a charge transport layer including two types of charge transporting materials, the charge transport layer serving as a top surface layer.

SUMMARY

Aspects of non-limiting embodiments of the present disclosure relate to an electrophotographic photosensitive member that includes a top surface layer including fluorine-containing resin particles, a fluorine-containing dispersant, and two or more charge transporting materials, the electrophotographic photosensitive member being capable of reducing fluctuations in charge transportability which may be caused by discharge products and limiting an increase in potential which may be caused subsequent to exposure when the electrophotographic photosensitive member is used over a prolonged period of time, compared with the case where, when the charge transporting materials are listed in order of decreasing HOMO energy levels, a difference in HOMO energy level between each adjacent two of the charge transporting materials is more than 0.2 eV or the case where the ratio A of the amount of each of the charge transporting materials to the total amount of the charge transporting materials does not satisfy the condition 1 described below.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrophotographic photosensitive member including a conductive support and a photosensitive layer disposed on the conductive support, wherein a top surface layer of the electrophotographic photosensitive member includes fluorine-containing resin particles, a fluorine-containing dispersant, and two or more charge transporting materials, wherein when the charge transporting materials are listed in order of decreasing HOMO energy levels, a difference in HOMO energy level between each adjacent two of the charge transporting materials is more than 0 eV and 0.2 eV or less, wherein a ratio A of an amount of each of the charge transporting materials to a total amount of the charge transporting materials satisfies a condition 1 below, $$[(100/N)-(100/N\times0.3)]\leq A\leq[(100/N)+(100/N\times0.3)] \quad \text{Condition 1}$$

where, in the condition 1, N represents the number of types of the charge transporting materials included in the top surface layer.

BRIEF DESCRIPTION OF THE DRAWINGS

Exemplary embodiments of the present disclosure will be described in detail based on the following figures, wherein.

DETAILED DESCRIPTION

Figure 1:
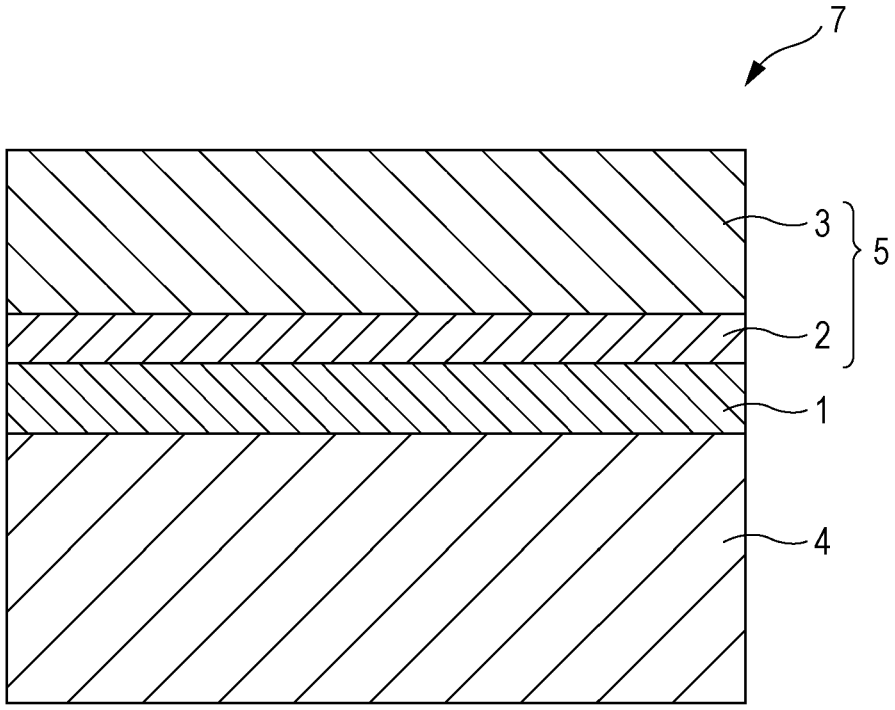
FIG. 1 is a schematic cross-sectional view of an electrophotographic photosensitive member according to an exemplary embodiment, illustrating an example of the structure of layers constituting the electrophotographic photosensitive member.

Exemplary embodiments of the present disclosure are described below. The following description and Examples below are intended to be illustrative of the exemplary embodiments and not restrictive of the scope of the exemplary embodiments.

In the present disclosure, when numerical ranges are described in a stepwise manner, the upper or lower limit of a numerical range may be replaced with the upper or lower limit of another numerical range, respectively. In the present disclosure, the upper and lower limits of a numerical range may be replaced with the upper and lower limits described in Examples below.

Each of the components described in the present disclosure may include plural types of substances that correspond to the component.

In the present disclosure, in the case where a composition includes plural substances that correspond to a component of the composition, the content of the component in the composition is the total content of the plural substances in the composition unless otherwise specified.

Electrophotographic Photosensitive Member

An electrophotographic photosensitive member according to this exemplary embodiment includes a conductive support and a photosensitive layer disposed on the conductive support. A top surface layer of the electrophotographic photosensitive member includes fluorine-containing resin particles, a fluorine-containing dispersant, and two or more charge transporting materials. When the charge transporting materials are listed in order of decreasing HOMO energy levels, a difference in HOMO energy level between each adjacent two of the charge transporting materials is more than 0 eV and 0.2 eV or less. The ratio A of the amount of each of the charge transporting materials to the total amount of the charge transporting materials satisfies the condition 1 below, $$[(100/N)-(100/N\times0.3)]\leq A\leq[(100/N)+(100/N\times0.3)] \quad \text{Condition 1}$$

where, in the condition 1, N represents the number of types of the charge transporting materials included in the top surface layer.

In an electrophotographic photosensitive member, discharge products react with and oxidize a charge transporting material included in a top surface layer. This may cause the fluctuations in charge transportability at the surface. Furthermore, a dispersant used for dispersing the particles included in the top surface layer may cause accumulation of charge when an electrophotographic photosensitive member is used over a prolonged period of time. This leads to an increase in potential after exposure.

The electrophotographic photosensitive member according to this exemplary embodiment may reduce the fluctuations in charge transportability caused by discharge products and limit an increase in potential which may occur after exposure when the electrophotographic photosensitive member is used over a prolonged period of time. The mechanisms are not clear but considered as follows.

The top surface layer of the electrophotographic photosensitive member according to this exemplary embodiment includes two or more charge transporting materials having close and different HOMO energy levels. This makes it possible to form an energy state in which the likelihood of the charge transporting materials being oxidized by the discharge products is low due to the interactions between the charge transporting materials. Even if some of the charge transporting materials are oxidized, the other charge transporting materials compensate for the reduction in charge transportability and consequently reduce the fluctuations in charge transportability.

In addition, even in the case where the top surface layer includes a fluorine-containing dispersant, since the top surface layer includes the charge transporting materials having close and different HOMO energy levels, even if the accumulation of charges occurs when the electrophotographic photosensitive member is used over a prolonged period of time, the desorption of accumulated charges is increased. This may limit an increase in potential after exposure.

Layer Structure of Electrophotographic Photosensitive Member

The structure of the layers constituting the electrophotographic photosensitive member is described below with reference to the attached drawings.

The electrophotographic photosensitive member 7 illustrated in FIG. 1 includes, for example, a conductive support 4, an undercoat layer 1 disposed on the conductive support 4, a charge generation layer 2 disposed on the undercoat layer 1, and a charge transport layer 3 disposed on the charge generation layer 2. The charge generation layer 2 and the charge transport layer 3 constitute a photosensitive layer 5. In the above example, the charge transport layer 3 serves as a top surface layer.

Note that the electrophotographic photosensitive member according to this exemplary embodiment does not necessarily include the undercoat layer 1.

The electrophotographic photosensitive member according to this exemplary embodiment may be a photosensitive member including a single-layer photosensitive layer that serves as both charge generation layer 2 and charge transport layer 3 in an integrated manner. In the case where the electrophotographic photosensitive member according to this exemplary embodiment includes a single-layer photosensitive layer, the single-layer photosensitive layer serves as a top surface layer.

The electrophotographic photosensitive member according to this exemplary embodiment may be a photosensitive member including a protection layer disposed on the charge transport layer 3 or the single-layer photosensitive layer. In the case where the electrophotographic photosensitive member according to this exemplary embodiment includes a protection layer, the protection layer serves as a top surface layer.

Thus, as described above, the top surface layer of the electrophotographic photosensitive member according to this exemplary embodiment is any of the charge transport layer, the single-layer photosensitive layer, and the protection layer.

The layers constituting the electrophotographic photosensitive member according to this exemplary embodiment are described in detail below. Note that the reference numerals used in FIG. 1 are omitted hereinafter.

Top Surface Layer

The top surface layer of the electrophotographic photosensitive member according to this exemplary embodiment includes fluorine-containing resin particles, a fluorine-containing dispersant, and two or more charge transporting materials.

Details of the fluorine-containing resin particles, the fluorine-containing dispersant, and the charge transporting materials included in the top surface layer are described below.

Note that the top surface layer may further include components other than the fluorine-containing resin particles, the fluorine-containing dispersant, or the charge transporting materials, depending on the type of layer (i.e., charge transport layer, single-layer photosensitive layer, or protection layer). The other components are described in the sections of the respective layers (i.e., charge transport layer, single-layer photosensitive layer, and protection layer).

Fluorine-Containing Resin Particles

The top surface layer includes fluorine-containing resin particles.

Only one type of the fluorine-containing resin particles may be used alone. Alternatively, two or more types of the fluorine-containing resin particles may also be used.

Fluorine-Containing Resin

Examples of the fluorine-containing resin constituting the fluorine-containing resin particles include:

(1) particles of a homopolymer of a fluoro-olefin; and (2) a copolymer of two or more monomers that are one or more fluoro-olefins and a non-fluorinated monomer (i.e., a monomer free of fluorine atoms).

Examples of the fluoro-olefin include perhalo-olefins, such as tetrafluoroethylene (TFE), perfluoro vinyl ether, hexafluoropropylene (HFP), and chlorotrifluoroethylene (CTFE); and non-perfluoro-olefins, such as vinylidene fluoride (VdF), trifluoroethylene, and vinyl fluoride. Among these, one or more fluoro-olefins selected from the group consisting of VdF, TFE, CTFE, and HFP may be used.

Examples of the non-fluorinated monomer include hydrocarbon olefins, such as ethylene, propylene, and butene; alkyl vinyl ethers, such as cyclohexyl vinyl ether (CHVE), ethyl vinyl ether (EVE), butyl vinyl ether, and methyl vinyl ether; alkenyl vinyl ethers, such as polyoxyethylene allyl ether (POEAE) and ethyl allyl ether; organosilicon compounds including a reactive α,β-unsaturated group, such as vinyltrimethoxysilane (VSi), vinyltriethoxysilane, and vinyltris(methoxyethoxy)silane; acrylic acid esters, such as methyl acrylate and ethyl acrylate; methacrylic acid esters, such as methyl methacrylate and ethyl methacrylate; and vinyl esters, such as vinyl acetate, vinyl benzoate, and "VeoVa" (vinyl ester produced by Shell). Among these, one or more non-fluorinated monomers selected from the groups consisting of the alkyl vinyl ethers, the allyl vinyl ethers, the vinyl esters, and the organosilicon compounds including a reactive α,β-unsaturated group may be used.

Among these, a fluorine-containing resin having a high fluoridation ratio is preferably used. It is more preferable to use one or more fluorine-containing resins selected from the group consisting of polytetrafluoroethylene (PTFE), a tetrafluoroethylene-hexafluoropropylene copolymer (FEP), a tetrafluoroethylene-perfluoro(alkyl vinyl ether) copolymer (PFA), an ethylene-tetrafluoroethylene copolymer (ETFE), and an ethylene-chlorotrifluoroethylene copolymer (ECTFE). It is further preferable to use one or more fluorine-containing resins selected from the group consisting of PTFE, FEP, and PFA.

Method for Forming Particles of Fluorine-Containing Resin

The method for forming particles of the fluorine-containing resin is not limited. For example, a method in which the particles are formed using radiation irradiation (hereinafter, particles formed by this method are referred to as "radiation irradiation-type fluorine-containing resin particles"; or a method in which the particles are formed using a polymerization method (hereinafter, particles formed by this method are referred to as "polymerization-type fluorine-containing resin particles") may be used.

The radiation irradiation-type fluorine-containing resin particles (fluorine-containing resin particles produced using radiation irradiation) are fluorine-containing resin particles produced simultaneously with radiation polymerization. The molecular weight and size of the polymerized fluorine-containing resin particles are reduced by radiation irradiation. Since a large amount of carboxylic acid is produced when the radiation irradiation is performed in the air, the radiation irradiation-type fluorine-containing resin particles also include a large amount of carboxyl groups.

The polymerization-type fluorine-containing resin particles (fluorine-containing resin particles produced using a polymerization method) are fluorine-containing resin particles that are produced while being polymerized by suspension polymerization, emulsion polymerization, or the like and that have not been irradiated with radiation. Since the polymerization-type fluorine-containing resin particles are produced by performing polymerization in the presence of a basic compound, the polymerization-type fluorine-containing resin particles include a basic compound as a residue.

Among the above types of fluorine-containing resin particles, the polymerization-type fluorine-containing resin particles may be used. As described above, the polymerization-type fluorine-containing resin particles are fluorine-containing resin particles that are produced while being polymerized by suspension polymerization, emulsion polymerization, or the like and that have not been irradiated with radiation.

In the production of the fluorine-containing resin particles by suspension polymerization, for example, a monomer used for forming the fluorine-containing resin and additives, such as a polymerization initiator and a catalyst, are suspended in a disperse medium and, subsequently, while the monomer is polymerized, the resulting polymer is formed into particles.

In the production of the fluorine-containing resin particles by emulsion polymerization, for example, a monomer used for forming the fluorine-containing resin and additives, such as a polymerization initiator and a catalyst, are emulsified using a surfactant (i.e., an emulsifier) in a disperse medium and, subsequently, while the monomer is polymerized, the resulting polymer is formed into particles.

Carboxyl Group

The fluorine-containing resin particles do not necessarily include carboxyl groups. Even when the fluorine-containing resin particles include carboxyl groups, the content of the carboxyl groups may be low. Specifically, the number of carboxyl groups included in the fluorine-containing resin particles is preferably 0 or more and 30 or less and is more preferably 0 or more and 20 or less per million carbon atoms in order to enhance the electrification characteristic of the electrophotographic photosensitive member.

Note that the term "carboxyl groups included in fluorine-containing resin particles" used herein refers to the carboxyl groups derived from the terminal carboxylic acid included in the fluorine-containing resin particles.

Examples of the method for reducing the amount of the carboxyl groups included in the fluorine-containing resin particles include, but are not limited to, the following:

in the step of forming the fluorine-containing resin into particles, (1) the fluorine-containing resin is not irradiated with radiation; or (2) the fluorine-containing resin is irradiated with radiation in the absence of oxygen or under the condition where the oxygen concentration is low.

The amount of the carboxyl groups included in the fluorine-containing resin particles is determined in the following manner.

Pretreatment

When the amount of carboxyl groups included in the fluorine-containing resin particles included in the top surface layer is measured, the top surface layer is immersed in a solvent (e.g., tetrahydrofuran) to dissolve, in the solvent (i.e., tetrahydrofuran), components other than the fluorine-containing resin particles or substances insoluble in the solvent. The resulting solution is added dropwise to pure water, and the resulting precipitate is separated by filtration. The insoluble substance obtained by filtration is dissolved in a solvent. The resulting solution is added dropwise to pure water, and the resulting precipitate is separated by filtration. The above operation is repeated five times to separate the fluorine-containing resin particles, which are used as a test sample.

Measurement

The amount of carboxyl groups included in the fluorine-containing resin particles is measured as in, for example, Japanese Laid Open Patent Application Publication No. H4-20507.

The fluorine-containing resin particles are formed into a film having a thickness of about 0.1 mm with a pressing machine. The infrared absorption spectrum of the film is measured. Then, the fluorine-containing resin particles are brought into contact with a fluorine gas to completely fluorinate the carboxylic acid terminals, and the infrared absorption spectrum of the fluorinated fluorine-containing resin particles is also measured. The number of the terminal carboxyl groups per million carbon atoms is determined using the formula below, on the basis of the difference between the two infrared absorption spectra.

$$\text{Number of Terminal carboxyl groups (per million carbon atoms)} = (l \times K)/t$$

where, l: absorbance

K: correction coefficient, t: film thickness (mm)

Note that the absorbance wavenumber of carboxyl groups is set to 3560 $cm^{-1}$, and the correction coefficient is set to 440.

Perfluorooctanoic Acid

The fluorine-containing resin particles do not necessarily include perfluorooctanoic acid (hereinafter, abbreviated as "PFOA") in order to enhance electrification characteristic. Even when the fluorine-containing resin particles include PFOA, the content of PFOA may be low.

Specifically, the amount of PFOA included in the fluorine-containing resin particles is preferably 0 ppb or more and 25 ppb or less, is more preferably 0 ppb or more and 20 ppb or less, and is further preferably 0 ppb or more and 15 ppb or less of the mass of the fluorine-containing resin particles.

Since PFOA is used or produced as a by-product in the production of the fluorine-containing resin particles (in particular, fluorine-containing resin particles such as polytetrafluoroethylene particles, modified polytetrafluoroethylene particles, and perfluoroalkyl ether/tetrafluoroethylene copolymer particles), the fluorine-containing resin particles include PFOA in many cases.

Since PFOA includes a carboxyl group, which degrades the electrification characteristic of the particles, the fluorine-containing resin particles do not necessarily include PFOA in order to enhance electrification characteristic. Even when the fluorine-containing resin particles include PFOA, the content of PFOA may be low.

Examples of the method for reducing the amount of PFOA include a method in which the fluorine-containing resin particles are sufficiently cleaned with pure water, alkaline water, an alcohol (e.g., methanol, ethanol, or isopropanol), a ketone (e.g., acetone, methyl ethyl ketone, or methyl isobutyl ketone), an ester (e.g., ethyl acetate), another common organic solvent (e.g., toluene or tetrahydrofuran), or the like. Although the cleaning may be performed at room temperature, cleaning the fluorine-containing resin particles while heating the particles enables an efficient reduction in PFOA content.

The content of PFOA in the fluorine-containing resin particles is determined by the following method.

Pretreatment

When the amount of PFOA included in the fluorine-containing resin particles included in the top surface layer is measured, the top surface layer is immersed in a solvent (e.g., tetrahydrofuran) to dissolve, in the solvent (i.e., tetrahydrofuran), components other than the fluorine-containing resin particles or substances insoluble in the solvent. The resulting solution is added dropwise to pure water, and the resulting precipitate is separated by filtration. Then, a solution containing PFOA is collected. The insoluble substance obtained by filtration is dissolved in a solvent. The resulting solution is added dropwise to pure water, and the resulting precipitate is separated by filtration. The above operation is repeated five times. The solution containing PFOA which has been collected in the above operations is used as a pretreated solution.

Measurement

A sample liquid is prepared using the pretreated solution in accordance with the method described in "Analytical Method for Perfluorooctanesulfonic Acid (PFOS) and Perfluorooctanoic Acid (PFOA) in Environmental Samples by LC/MS" published by Research Institute for Environmental Sciences and Public Health of Iwate Prefecture and used for measuring the PFOA content.

Basic Compound

The fluorine-containing resin particles do not necessarily include a basic compound. Even when the fluorine-containing resin particles include a basic compound, the content of the basic compound may be low.

Specifically, the amount of the basic compound included in the fluorine-containing resin particles is preferably 0 ppm or more and 3 ppm or less, is more preferably 0 ppm or more and 1.5 ppm or less, and is further preferably 0 ppm or more and 1.2 ppm or less in order to enhance the electrification characteristic of the electrophotographic photosensitive member. Note that "ppm" is on a mass basis.

Specific examples of the basic compound included in the fluorine-containing resin particles include the following:

1) a basic compound derived from the polymerization initiator used when particles of the fluorine-containing resin are formed simultaneously with polymerization;
2) a basic compound used in the step of performing aggregation subsequent to polymerization; and
3) a basic compound used as a dispersing aid for stabilizing a dispersion liquid subsequent to polymerization.

Examples of the basic compound include amines; hydroxides of an alkali metal or an alkaline-earth metal; oxides of an alkali metal or an alkaline-earth metal; and salts of acetic acid (e.g., in particular, amines).

The basic compound is, for example, a basic compound having a boiling point (boiling point at normal pressure (i.e., 1 atmospheric pressure)) of 40° C. or more and 130° C. or less, preferably having a boiling point of 50° C. or more and 110° C. or less, and more preferably having a boiling point of 60° C. or more and 90° C. or less.

Examples of the amines include a primary amine, a secondary amine, and a tertiary amine.

Examples of the primary amine include methylamine, ethylamine, propylamine, isopropylamine, n-butylamine, isobutylamine, t-butylamine, hexylamine, 2-ethylhexylamine, sec-butylamine, allylamine, and methylhexylamine.

Examples of the secondary amine include dimethylamine, diethylamine, di-n-propylamine, diisopropylamine, di-n-butylamine, diisobutylamine, di-t-butylamine, dihexylamine, di(2-ethylhexyl)amine, N-isopropyl-N-isobutylamine, di(2-ethylhexyl)amine, di-sec-butylamine, diallylamine, N-methylhexylamine, 3-pipecolic acid, 4-pipecolic acid, 2,4-lupetidine, 2,6-lupetidine, 3,5-lupetidine, morpholine, and N-methylbenzylamine.

Examples of the tertiary amine include trimethylamine, triethylamine, tri-n-propylamine, triisopropylamine, tri-n-butylamine, triisobutylamine, tri-t-butylamine, trihexylamine, tri(2-ethylhexyl)amine, N-methylmorpholine, N,N-dimethylallylamine, N-methyldiallylamine, triallylamine, N,N-dimethylallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-collidine, 2-methyl-4-ethylpyridine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5-nonyl)pyridine, imidazole, and N-methylpiperazine.

Examples of the hydroxides of an alkali metal or an alkaline-earth metal include NaOH, KOH, $Ca(OH)_2$, $Mg(OH)_2$, and $Ba(OH)_2$.

Examples of the oxides of an alkali metal or an alkaline-earth metal include CaO and MgO.

Examples of the salts of acetic acid include zinc acetate and sodium acetate.

Examples of the method for reducing the content of the basic compound included in the fluorine-containing resin particles include, but are not limited to, the following:

(1) a method in which, after the fluorine-containing resin particles have been produced, they are cleaned with water, an organic solvent (e.g., an alcohol, such as methanol, ethanol, or isopropanol, or tetrahydrofuran), or the like; and (2) a method in which, after the fluorine-containing resin particles have been produced, they are heated to, for example, a temperature of 200° C. or more and 250° C. or less to decompose or vaporize the basic compound.

The content of the basic compound in the fluorine-containing resin particles is determined by the following method.

Pretreatment

When the amount of the basic compound included in the fluorine-containing resin particles included in the top surface layer is measured, the top surface layer is immersed in a solvent (e.g., tetrahydrofuran) to dissolve, in the solvent (i.e., tetrahydrofuran), components other than the fluorine-containing resin particles or substances insoluble in the solvent. The resulting solution is added dropwise to pure water, and the resulting precipitate is separated by filtration. Then, a solution containing the basic compound is collected. The insoluble substance obtained by filtration is dissolved in a solvent. The resulting solution is added dropwise to pure water, and the resulting precipitate is separated by filtration. The above operation is repeated five times. The solution containing the basic compound which has been collected in the above operations is used as a test sample.

Measurement

Solutions of a basic compound having known concentrations (solvent: methanol) are subjected to gas chromatography. A calibration curve (from 0 to 100 ppm) is prepared on the basis of the basic compound concentrations in the above solutions and the areas of the respective peaks.

Subsequently, the test sample is subjected to gas chromatography, and the content of the basic compound in the fluorine-containing resin particles is calculated on the basis of the peak area measured and the above calibration curve. The measurement is conducted under the following conditions.

Measurement Conditions

Headspace sampler: "HP7694" produced by Hewlett-Packard Development Company, L.P.

Measurement device: gas chromatograph "HP6890 series" produced by Hewlett-Packard Development Company, L.P.

Detector: flame ionization detector (FID)

Column: "HP19091S-433" produced by Hewlett-Packard Development Company, L.P.

Sample heating time: 10 mins

Sprit ratio: 300:1

Flow rate: 1.0 ml/min

Column heating temperature profile: 60° C. (3 mins), 60° C./min, 200° C. (1 min)

Average Particle Size

The average size of the fluorine-containing resin particles is preferably, but not limited to, 0.2 μm or more and 4.5 μm or less and is more preferably 0.2 μm or more and 4.0 μm or less.

The average size of the fluorine-containing resin particles is determined by the following method.

A specific one of the fluorine-containing resin particles (a secondary particle formed by aggregation of primary particles) is observed with a scanning electron microscope (SEM), for example, at a magnification of 5000 times or more, and the maximum diameter of the fluorine-containing resin particle is measured. The maximum diameters of 50 particles are measured in the above-described manner, and the arithmetic average thereof is used as the average size of the fluorine-containing resin particles. Note that the SEM is "JSM-6700F" produced by JEOL Ltd, and a secondary electron image formed at an accelerating voltage of 5 kV is observed.

Specific Surface Area

The specific surface area (BET specific surface area) of the fluorine-containing resin particles is preferably 5 $m^2/g$ or more and 15 $m^2/g$ or less and is more preferably 7 $m^2/g$ or more and 13 $m^2/g$ or less in consideration of dispersion stability.

The above specific surface area is determined using a BET specific surface area gage "FlowSorb II 2300" produced by Shimadzu Corporation by a nitrogen purging method.

Apparent Density

The apparent density of the fluorine-containing resin particles is preferably 0.2 g/ml or more and 0.5 g/ml or less and is more preferably 0.3 g/ml or more and 0.45 g/ml or less in consideration of dispersion stability.

The above apparent density is determined in accordance with JIS K 6891:1995.

Melting Temperature

The melting temperature of the fluorine-containing resin particles is preferably 300° C. or more and 340° C. or less and is more preferably 325° C. or more and 335° C. or less.

The above melting temperature is a melting point determined in accordance with JIS K 6891:1995.

Content

The amount of the fluorine-containing resin particles included in the top surface layer is preferably 1% by mass or more and 20% by mass or less, is more preferably 5% by mass or more and 15% by mass or less, and is further preferably 7% by mass or more and 10% by mass or less of the total mass of the top surface layer.

Fluorine-Containing Dispersant

The top surface layer includes a fluorine-containing dispersant.

Since the fluorine-containing dispersant is an agent used for dispersing the fluorine-containing resin particles, it may be adhered on the surfaces of the fluorine-containing resin particles.

Only one type of fluorine-containing dispersant may be used alone. Alternatively, two or more types of fluorine-containing dispersants may be used in combination.

Examples of the fluorine-containing dispersant include a homopolymer or copolymer of a polymerizable compound including a fluoroalkyl group (hereinafter, such a homopolymer or copolymer is referred to as "fluoroalkyl group-containing polymer") and a fluorine-containing surfactant. Among these, the fluoroalkyl group-containing polymer may be used.

Specific examples of the fluoroalkyl group-containing polymer include a homopolymer of a (meth)acrylate including a fluoroalkyl group and a random or block copolymer of a (meth)acrylate including a fluoroalkyl group and a monomer that does not include fluorine atoms.

Note that the term "(meth)acrylate" used herein refers to both acrylate and methacrylate.

Examples of the (meth)acrylate including a fluoroalkyl group include 2,2,2-trifluoroethyl (meth)acrylate and 2,2,3,3,3-pentafluoropropyl (meth)acrylate.

Examples of the monomer that does not include fluorine atoms include (meth)acrylate, isobutyl (meth)acrylate, t-butyl (meth)acrylate, isooctyl (meth)acrylate, lauryl (meth) acrylate, stearyl (meth)acrylate, isobornyl (meth)acrylate, cyclohexyl (meth)acrylate, 2-methoxyethyl (meth)acrylate, methoxy triethylene glycol (meth)acrylate, 2-ethoxyethyl (meth)acrylate, tetrahydrofurfuryl (meth)acrylate, benzyl (meth)acrylate, ethylcarbitol (meth)acrylate, phenoxyethyl (meth)acrylate, 2-hydroxy (meth)acrylate, 2-hydroxypropyl (meth)acrylate, 4-hydroxybutyl (meth)acrylate, methoxy polyethylene glycol (meth)acrylate, methoxy polyethylene glycol (meth)acrylate, phenoxy polyethylene glycol (meth) acrylate, hydroxyethyl o-phenylphenol (meth)acrylate, and o-phenylphenol glycidyl ether (meth)acrylate.

Examples of the fluorine-containing dispersant which are other than the above-described fluorine-containing dispersants include the block polymers and branched polymers disclosed in, for example, U.S. Pat. No. 5,637,142 and Japanese Patent No. 4251662.

The fluoroalkyl group-containing polymer preferably includes a fluoroalkyl group-containing polymer including the structural unit represented by Formula (FA) below and more preferably includes a fluoroalkyl group-containing polymer including the structural unit represented by Formula (FA) below and the structural unit represented by Formula (FB) below.

The fluoroalkyl group-containing polymer including the structural unit represented by Formula (FA) below and the structural unit represented by Formula (FB) below is described below.

(FA)

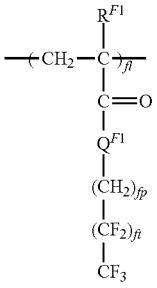

(FB)

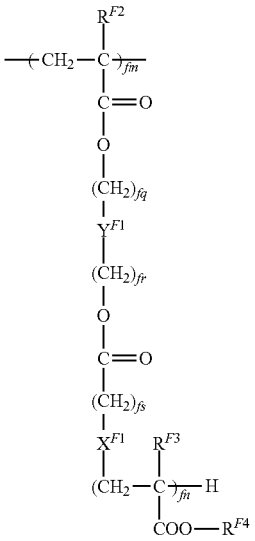

In Formulae (FA) and (FB), $R^{F1}$, $R^{F2}$, $R^{F3}$, and $R^{F4}$ each independently represent a hydrogen atom or an alkyl group;

$X^{F1}$ represents an alkylene chain, a halogen-substituted alkylene chain, —S—, —O—, —NH—, or a single bond;

$Y^{F1}$ represents an alkylene chain, a halogen-substituted alkylene chain, —($C_{fx}H_{2fx-1}$(OH))—, or a single bond;

$Q^{F1}$ represents —O— or —NH—;

fl, fm, and fn each independently represent an integer of 1 or more;

fp, fq, fr, and fs each independently represent 0 or an integer of 1 or more;

ft represents an integer of 1 to 7; and fx represents an integer of 1 or more.

The groups represented by $R^{F1}$, $R^{F2}$, $R^{F3}$, and $R^{F4}$ in Formulae (FA) and (FB) are preferably selected from a hydrogen atom, a methyl group, an ethyl group, a propyl group, and the like, are more preferably selected from a hydrogen atom and a methyl group, and are further preferably methyl groups.

The alkylene chains (i.e., unsubstituted alkylene chains and halogen-substituted alkylene chains) represented by $X^{F1}$ and $Y^{F1}$ in Formulae (FA) and (FB) may be linear or branched alkylene chains having 1 to 10 carbon atoms;

fx in —($C_{fx}H_{2fx-1}$(OH))— represented by $Y^{F1}$ may represent an integer of 1 to 10;

fp, fq, fr, and fs may each independently represent 0 or an integer of 1 to 10; and fn may represent, for example, an integer of 1 to 60.

In the fluoroalkyl group-containing polymer including the structural unit represented by Formula (FA) and the structural unit represented by Formula (FB), the ratio between the structural unit represented by Formula (FA) and the structural unit represented by Formula (FB), that is, fl:fm, is preferably 1:9 or more and 9:1 or less and is more preferably 3:7 or more and 7:3 or less.

The fluoroalkyl group-containing polymer may be a polymer produced so as to include the structural unit represented by Formula (FC) below in addition to the structural unit represented by Formula (FA) and the structural unit represented by Formula (FB). In such a case, as for the proportion of the structural unit represented by Formula (FC), the ratio (fl+fm:fz) between the structural unit represented by Formula (FC) and the total (fl+fm) of the structural units represented by Formulae (FA) and (FB) is preferably 10:0 or more and 7:3 or less and is more preferably 9:1 or more and 7:3 or less.

(FC)

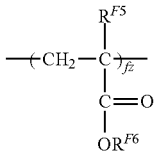

In Formula (FC), $R^{F5}$ and $R^{F6}$ each independently represent a hydrogen atom or an alkyl group; and fz represents an integer of 1 or more.

The groups represented by $R^{F5}$ and $R^{F6}$ in Formula (FC) are preferably selected from a hydrogen atom, a methyl group, an ethyl group, a propyl group, and the like, are more preferably selected from a hydrogen atom and a methyl group, and are further preferably methyl groups.

Examples of commercial products of the fluoroalkyl group-containing polymer include "GF300" and "GF400" produced by TOAGOSEI CO., LTD.; "SURFLON" (registered trademark) series produced by AGC Seimi Chemical Co., Ltd.; "FTERGENT" series produced by NEOS Co., Ltd.; "PF" series produced by KITAMURA CHEMICALS CO., LTD.; "MEGAFACE" (registered trademark) series produced by DIC Corporation; and "FC" series produced by 3M Company.

Weight Average Molecular Weight Mw

The weight average molecular weight Mw of the fluoroalkyl group-containing polymer is preferably 20,000 or more and 200,000 or less and is more preferably 50,000 or more and 200,000 or less in order to enhance the dispersibility of the fluorine-containing resin particles.

The weight average molecular weight of the fluoroalkyl group-containing polymer is measured by gel permeation chromatography (GPC). The measurement of molecular weight by GPC is conducted using, for example, "GPCHLC-8120" produced by Tosoh Corporation as measuring equipment, "TSKgel GMHHR-M+TSKgel GMHHR-M" (7.8 mm I.D. 30 cm) produced by Tosoh Corporation as columns, and a chloroform solvent. The weight average molecular weight of the fluoroalkyl group-containing polymer is calculated on the basis of the measurement results using a molecular weight calibration curve prepared using monodisperse polystyrene standard samples.

Content

The content of the fluorine-containing dispersant is preferably 0.25% by mass or more and 0.40% by mass or less, is more preferably 0.25% by mass or more and 0.35% by mass or less, and is further preferably 0.25% by mass or more and 0.30% by mass or less of the total mass of the top surface layer in order to limit a potential increase which may occur after exposure when the electrophotographic photosensitive member is used over a prolonged period of time.

The content of the fluorine-containing dispersant is preferably, for example, 0.5% by mass or more and 10% by mass or less and is more preferably 1% by mass or more and 7% by mass or less of the amount of the fluorine-containing resin particles in order to produce the function of the fluorine-containing dispersant as a dispersant.

Method for Attaching Fluorine-Containing Dispersant Onto Surfaces

As mentioned above, the fluorine-containing dispersant may be adhered on the surfaces of the fluorine-containing resin particles.

Examples of the method for attaching the fluorine-containing dispersant onto the surfaces of the fluorine-containing resin particles include, but are not limited to, the methods (1) to (3) below.

(1) a method in which the fluorine-containing resin particles and the fluorine-containing dispersant are mixed with a disperse solvent to prepare a dispersion liquid containing the fluorine-containing resin particles;

(2) a method in which the fluorine-containing resin particles and the fluorine-containing dispersant are mixed with each other using a dry powder mixer to attach the fluorine-containing dispersant to the fluorine-containing resin particles; and (3) a method in which, while the fluorine-containing resin particles are stirred, the fluorine-containing dispersant dissolved in a solvent is added dropwise to the fluorine-containing resin particles, and the solvent is subsequently removed from the resulting mixture.

Two or More Charge Transporting Materials

The top surface layer includes two or more charge transporting materials.

The charge transporting materials included in the top surface layer need to satisfy the following condition: when the charge transporting materials are listed in order of decreasing HOMO energy levels, a difference in HOMO energy level between each adjacent two of the charge transporting materials is more than 0 eV and 0.2 eV or less.

As described above, the top surface layer includes two or more charge transporting materials having different but close HOMO energy levels.

In order to reduce the fluctuations in charge transportability caused by the discharge products and limit the potential increase which may occur after exposure when the electrophotographic photosensitive member is used over a prolonged period of time, the difference in HOMO energy level between each adjacent two of the charge transporting materials listed in order of decreasing HOMO energy levels is preferably 0.01 eV or more and 0.2 eV or less and is more preferably 0.05 eV or more and 0.15 eV or less.

In consideration of charge transportability, the HOMO energy level of each of the charge transporting materials is preferably 5.0 eV or more and 5.6 eV or less, is more preferably 5.1 eV or more and 5.5 eV or less, and is further preferably 5.20 eV or more and 5.45 eV or less.

The HOMO energy levels of the charge transporting materials are determined by the following method.

Specifically, the ionization potential of a charge transporting material measured using "Photoemission Yield Spectroscopy in Air AC-2" produced by RIKEN KEIKI Co., Ltd. is considered the HOMO energy level of the charge transporting material.

The charge transporting materials included in the top surface layer also need to satisfy the following condition: the ratio A of the amount of each of the charge transporting materials to the total amount of the charge transporting materials satisfies the condition 1 below, $$[(100/N)-(100/N\times0.3)]\leq A\leq[(100/N)+(100/N\times0.3)] \quad \text{Condition 1}$$

where, in the condition 1, N represents the number of types of the charge transporting materials included in the top surface layer.

In other words, when the charge transporting materials satisfy the condition 1, in the case where the top surface layer includes, for example, three types of charge transporting materials, the ratio A of the amount of each of the charge transporting materials satisfies the following:

$$(100/3)-(100/N\times0.3)\leq A\leq(100/3)+(100/3\times0.3)$$

This means that it is desirable that variations in the contents of the charge transporting materials in the top surface layer of the electrophotographic photosensitive member according to this exemplary embodiment be not large.

In order to reduce the fluctuations in charge transportability caused by the discharge products and limit the potential increase which may occur after exposure when the electrophotographic photosensitive member is used over a prolonged period of time, the ratio A of the amount of each of the charge transporting materials included in the top surface layer to the total amount of the charge transporting materials preferably satisfies the condition 2 below and more preferably satisfies the condition 3 below, $$[(100/N)-(100/N\times0.2)]\leq A\leq[(100/N)+(100/N\times0.2)] \quad \text{Condition 2}$$

$$[(100/N)-(100/N\times0.1)]\leq A\leq[(100/N)+(100/N\times0.1)] \quad \text{Condition 3}$$

where, in conditions 2 and 3, N represents the number of types of the charge transporting materials included in the top surface layer.

Examples of the charge transporting materials included in the top surface layer include, but are not limited to, the following electron transporting compounds: quinones, such as p-benzoquinone, chloranil, bromanil, and anthraquinone; tetracyanoquinodimethane compounds; fluorenones, such as 2,4,7-trinitrofluorenone; xanthones; benzophenones; cyanovinyl compounds; and ethylenes. Examples of the charge transporting materials included in the top surface layer further include hole transporting compounds, such as triarylamines, benzidines, arylalkanes, aryl-substituted ethylenes, stilbenes, anthracenes, and hydrazones.

Among the above compounds, triarylamines and benzidines may be used as a charge transporting material in terms of charge mobility. Among the triarylamines, in particular, the charge transporting material represented by Formula (CT1) below (hereinafter, referred to as "butadiene charge transporting material), which is an example of the triarylamines, may be used. Among the benzidines, in particular, the charge transporting material represented by Formula (CT2) below (hereinafter, referred to as "benzidine charge transporting material) may be used.

Butadiene Charge Transporting Material

The butadiene charge transporting material is described below. The butadiene charge transporting material is represented by Formula (CT1) below.

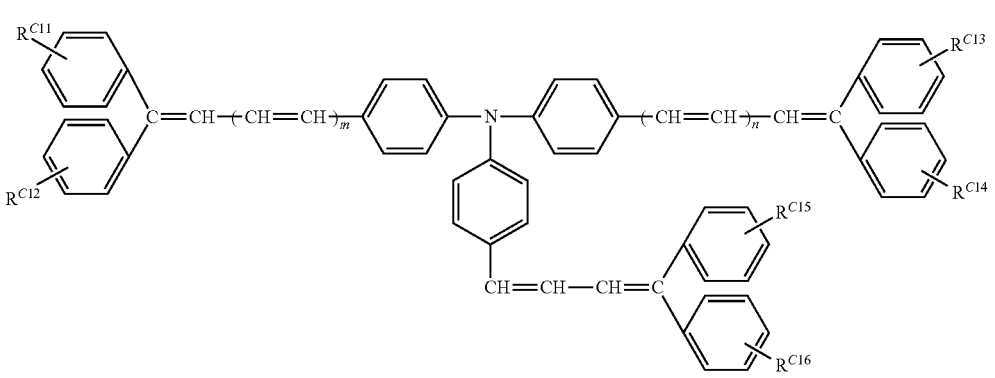

(CT1)

In Formula (CT1), $R^{C11}$, $R^{C12}$, $R^{C13}$, $R^{C14}$, $R^{C15}$, and $R^{C16}$ each independently represent a hydrogen atom, a halogen atom, an alkyl group having 1 to 20 carbon atoms, an alkoxy group having 1 to 20 carbon atoms, or an aryl group having 6 to 30 carbon atoms; a pair of adjacent substituent groups may be bonded to each other to form a hydrocarbon ring structure; and n and m each independently represent 0, 1, or 2.

Examples of the halogen atom represented by $R^{C11}$, $R^{C12}$, $R^{C13}$, $R^{C14}$, $R^{C15}$, and $R^{C16}$ in Formula (CT1) include a fluorine atom, a chlorine atom, a bromine atom, and an iodine atom. Among the above halogen atoms, a fluorine atom and a chlorine atom are preferable, and a chlorine atom is more preferable.

Examples of the alkyl group represented by $R^{C11}$, $R^{C12}$, $R^{C13}$, $R^{C14}$, $R^{C15}$, and $R^{C16}$ in Formula (CT1) include linear and branched alkyl groups having 1 to 20 carbon atoms, preferably 1 to 6 carbon atoms, and more preferably 1 to 4 carbon atoms.

Specific examples of the linear alkyl group include a methyl group, an ethyl group, an n-propyl group, an n-butyl group, an n-pentyl group, an n-hexyl group, an n-heptyl group, an n-octyl group, an n-nonyl group, an n-decyl group, an n-undecyl group, an n-dodecyl group, an n-tridecyl group, an n-tetradecyl group, an n-pentadecyl group, an n-hexadecyl group, an n-heptadecyl group, an n-octadecyl group, an n-nonadecyl group, and an n-icosyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, an isoundecyl group, a sec-undecyl group, a tert-undecyl group, a neoundecyl group, an isododecyl group, a sec-dodecyl group, a tert-dodecyl group, a neododecyl group, an isotridecyl group, a sec-tridecyl group, a tert-tridecyl group, a neotridecyl group, an isotetradecyl group, a sec-tetradecyl group, a tert-tetradecyl group, a neotetradecyl group, a 1-isobutyl-4-ethyloctyl group, an isopentadecyl group, a sec-pentadecyl group, a tert-pentadecyl group, a neopentadecyl group, an isohexadecyl group, a sec-hexadecyl group, a tert-hexadecyl group, a neohexadecyl group, a 1-methylpentadecyl group, an isoheptadecyl group, a sec-heptadecyl group, a tert-heptadecyl group, a neoheptadecyl group, an isooctadecyl group, a sec-octadecyl group, a tert-octadecyl group, a neooctadecyl group, an isononadecyl group, a sec-nonadecyl group, a tert-nonadecyl group, a neononadecyl group, a 1-methyloctyl group, an isoicosyl group, a sec-icosyl group, a tert-icosyl group, and a neoicosyl group.

Among the above alkyl groups, in particular, lower alkyl groups, such as a methyl group, an ethyl group, and an isopropyl group, may be used.

Examples of the alkoxy group represented by $R^{C11}$, $R^{C12}$, $R^{C13}$, $R^{C14}$, $R^{C15}$, and $R^{C16}$ in Formula (CT1) include linear and branched alkoxy groups having 1 to 20 carbon atoms, preferably 1 to 6 carbon atoms, and more preferably 1 to 4 carbon atoms.

Specific examples of the linear alkoxy group include a methoxy group, an ethoxy group, an n-propoxy group, an n-butoxy group, an n-pentyloxy group, an n-hexyloxy group, an n-heptyloxy group, an n-octyloxy group, an n-nonyloxy group, an n-decyloxy group, an n-undecyloxy group, an n-dodecyloxy group, an n-tridecyloxy group, an n-tetradecyloxy group, an n-pentadecyloxy group, an n-hexadecyloxy group, an n-heptadecyloxy group, an n-octadecyloxy group, an n-nonadecyloxy group, and an n-icosyloxy group.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, a tert-decyloxy group, an isoundecyloxy group, a sec-undecyloxy group, a tert-undecyloxy group, a neoundecyloxy group, an isododecyloxy group, a sec-dodecyloxy group, a tert-dodecyloxy group, a neododecyloxy group, an isotridecyloxy group, a sec-tridecyloxy group, a tert-tridecyloxy group, a neotridecyloxy group, an isotetradecyloxy group, a sec-tetradecyloxy group, a tert-tetradecyloxy group, a neotetradecyloxy group, a 1-isobutyl-4-ethyloctyloxy group, an isopentadecyloxy group, a sec-pentadecyloxy group, a tert-pentadecyloxy group, a neopentadecyloxy group, an isohexadecyloxy group, a sec-hexadecyloxy group, a tert-hexadecyloxy group, a neohexadecyloxy group, a 1-methylpentadecyloxy group, an isoheptadecyloxy group, a sec-heptadecyloxy group, a tert-heptadecyloxy group, a neoheptadecyloxy group, an isooctadecyloxy group, a sec-octadecyloxy group, a tert-octadecyloxy group, a neooctadecyloxy group, an isononadecyloxy group, a sec-nonadecyloxy group, a tert-nonadecyloxy group, a neononadecyloxy group, a 1-methyloctyloxy group, an isoicosyloxy group, a sec-icosyloxy group, a tert-icosyloxy group, and a neoicosyloxy group.

Among the above alkoxy groups, in particular, a methoxy group may be used.

Examples of the aryl group represented by $R^{C11}$, $R^{C12}$, $R^{C13}$, $R^{C14}$, $R^{C15}$, and $R^{C16}$ in Formula (CT1) include aryl groups having 6 to 30 carbon atoms, preferably 6 to 20 carbon atoms, and more preferably 6 to 16 carbon atoms.

Specific examples of such aryl groups include a phenyl group, a naphthyl group, a phenanthryl group, and a biphenylyl group.

Among the above aryl groups, in particular, a phenyl group and a naphthyl group may be used.

The substituent groups represented by $R^{C11}$, $R^{C12}$, $R^{C13}$, $R^{C14}$, $R^{C15}$, and $R^{C16}$ in Formula (CT1) may further include a substituent. Examples of the substituent include the atoms and groups described above as examples, such as a halogen atom, an alkyl group, an alkoxy group, and an aryl group.

Examples of a group with which a pair of adjacent substituent groups selected from $R^{C11}$, $R^{C12}$, $R^{C13}$, $R^{C14}$, $R^{C15}$, and $R^{C16}$ in Formula (CT1), that is, for example, the pair of $R^{C11}$ and $R^{C12}$, the pair of $R^{C13}$ and $R^{C14}$, or the pair of $R^{C15}$ and $R^{C16}$, are bonded to each other to form a hydrocarbon ring structure include a single bond, a 2,2'-methylene group, a 2,2'-ethylene group, and a 2,2'-vinylene group. In particular, a single bond and a 2,2'-methylene group may be used.

Specific examples of the hydrocarbon ring structure include a cycloalkane structure, a cycloalkene structure, and a cycloalkane polyene structure.

In Formula (CT1), n and m may be 1.

It is preferable that, in Formula (CT1), $R^{C11}$, $R^{C12}$, $R^{C13}$, $R^{C14}$, $R^{C15}$, and $R^{C16}$ represent a hydrogen atom, an alkyl group having 1 to 20 carbon atoms, or an alkoxy group having 1 to 20 carbon atoms and that m and n represent 1 or 2 in order to form a photosensitive layer having high charge transportability, that is, a charge transport layer. It is more preferable that $R^{C11}$, $R^{C12}$, $R^{C13}$, $R^{C14}$, $R^{C15}$, and $R^{C16}$ represent a hydrogen atom and that m and n represent 1.

In other words, it is more preferable that the butadiene charge transporting material (CT1) be the charge transporting material represented by Structural Formula (CT1A) below, which is the exemplified compound (CT1-3).

(CT1A)

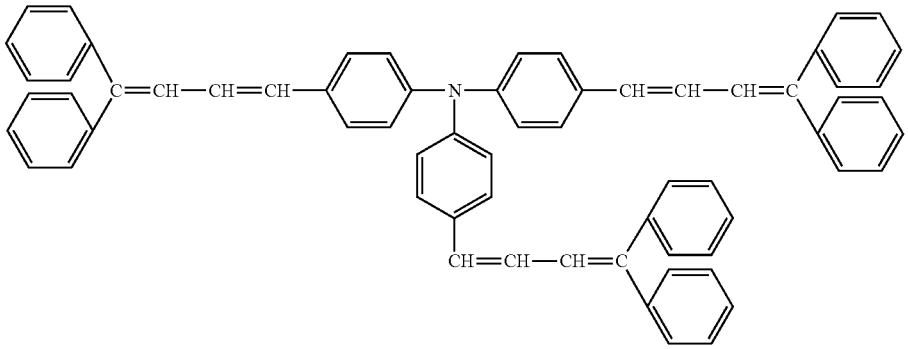

Specific examples of the butadiene charge transporting material (CT1) include, but are not limited to, the following compounds. Note that, hereinafter, numbers are assigned to the exemplified compounds as "exemplified compound (CT1-[Number])". Specifically, for example, the exemplified compound 15 is referred to as "exemplified compound (CT1-15)".

| No. | m | N | $R^{C11}$ | $R^{C12}$ | $R^{C13}$ | $R^{C14}$ | $R^{C15}$ | $R^{C16}$ |
|---|---|---|---|---|---|---|---|---|
| CT1-1 | 1 | 1 | 4-$CH_3$ | 4-$CH_3$ | 4-$CH_3$ | 4-$CH_3$ | H | H |
| CT1-2 | 2 | 2 | H | H | H | H | 4-$CH_3$ | 4-$CH_3$ |
| CT1-3 | 1 | 1 | H | H | H | H | H | H |
| CT1-4 | 2 | 2 | H | H | H | H | H | H |
| CT1-5 | 1 | 1 | 4-$CH_3$ | 4-$CH_3$ | 4-$CH_3$ | H | H | H |
| CT1-6 | 0 | 1 | H | H | H | H | H | H |
| CT1-7 | 0 | 1 | 4-$CH_3$ | 4-$CH_3$ | 4-$CH_3$ | 4-$CH_3$ | 4-$CH_3$ | 4-$CH_3$ |

-continued

| No. | m | N | $R^{C11}$ | $R^{C12}$ | $R^{C13}$ | $R^{C14}$ | $R^{C15}$ | $R^{C16}$ |
|---|---|---|---|---|---|---|---|---|
| CT1-8 | 0 | 1 | 4-$CH_3$ | 4-$CH_3$ | H | H | 4-$CH_3$ | 4-$CH_3$ |
| CT1-9 | 0 | 1 | H | H | 4-$CH_3$ | 4-$CH_3$ | H | H |
| CT1-10 | 0 | 1 | H | H | 4-$CH_3$ | 4-$CH_3$ | H | H |
| CT1-11 | 0 | 1 | 4-$CH_3$ | H | H | H | 4-$CH_3$ | H |
| CT1-12 | 0 | 1 | 4-$OCH_3$ | H | H | H | 4-$OCH_3$ | H |
| CT1-13 | 0 | 1 | H | H | 4-$OCH_3$ | 4-$OCH_3$ | H | H |
| CT1-14 | 0 | 1 | 4-$OCH_3$ | H | 4-$OCH_3$ | H | 4-$OCH_3$ | 4-$OCH_3$ |
| CT1-15 | 0 | 1 | 3-$CH_3$ | H | 3-$CH_3$ | H | 3-$CH_3$ | H |
| CT1-16 | 1 | 1 | 4-$CH_3$ | 4-$CH_3$ | 4-$CH_3$ | 4-$CH_3$ | 4-$CH_3$ | 4-$CH_3$ |
| CT1-17 | 1 | 1 | 4-$CH_3$ | 4-$CH_3$ | H | H | 4-$CH_3$ | 4-$CH_3$ |
| CT1-18 | 1 | 1 | H | H | 4-$CH_3$ | 4-$CH_3$ | H | H |
| CT1-19 | 1 | 1 | H | H | 3-$CH_3$ | 3-$CH_3$ | H | H |
| CT1-20 | 1 | 1 | 4-$CH_3$ | H | H | H | 4-$CH_3$ | H |
| CT1-21 | 1 | 1 | 4-$OCH_3$ | H | H | H | 4-$OCH_3$ | H |
| CT1-22 | 1 | 1 | H | H | 4-$OCH_3$ | 4-$OCH_3$ | H | H |
| CT1-23 | 1 | 1 | 4-$OCH_3$ | H | 4-$OCH_3$ | H | 4-$OCH_3$ | 4-$OCH_3$ |
| CT1-24 | 1 | 1 | 3-$CH_3$ | H | 3-$CH_3$ | H | 3-$CH_3$ | H |

The abbreviations used for describing the above exemplified compounds stand for the following. The numbers attached to the substituent groups each refer to the position at which the substituent group is bonded to a benzene ring.

—$CH_3$: Methyl group

—$OCH_3$: Methoxy group

Only one type of the butadiene charge transporting material (CT1) may be used alone. Alternatively, two or more types of the butadiene charge transporting materials (CT1) may be used in combination.

Benzidine Charge Transporting Material

Among the above-described benzidines, the benzidine charge transporting material (CT2) represented by Formula (CT2) below is preferable in consideration of charge mobility.

It is particularly preferable, in consideration of charge mobility, to use the butadiene charge transporting material (CT1) and the benzidine charge transporting material (CT2) in combination as charge transporting materials.

The benzidine charge transporting material is described below. The benzidine charge transporting material is represented by Formula (CT2) below.

(CT2)

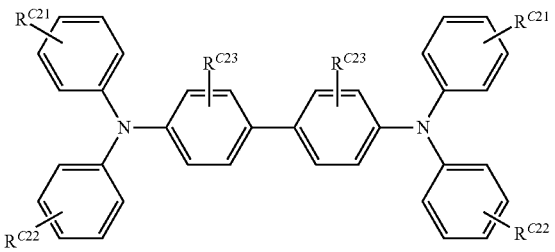

In Formula (CT2), $R^{C21}$, $R^{C22}$, and $R^{C23}$ each independently represent a hydrogen atom, a halogen atom, a hydroxyl group, a formyl group, an alkyl group, an alkoxy group, or an aryl group.

Examples of the halogen atom represented by $R^{C21}$, $R^{C22}$, and $R^{C23}$ in Formula (CT2) include a fluorine atom, a chlorine atom, a bromine atom, and an iodine atom. Among the above halogen atoms, a fluorine atom and a chlorine atom are preferable, and a chlorine atom is more preferable.

Examples of the alkyl group represented by $R^{C21}$, $R^{C22}$, and $R^{C23}$ in Formula (CT2) include linear and branched alkyl groups having 1 to 10 carbon atoms, preferably 1 to 6 carbon atoms, and more preferably 1 to 4 carbon atoms.

Specific examples of the linear alkyl group include a methyl group, an ethyl group, an n-propyl group, an n-butyl group, an n-pentyl group, an n-hexyl group, an n-heptyl group, an n-octyl group, an n-nonyl group, and an n-decyl group.

Specific examples of the branched alkyl group include an isopropyl group, an isobutyl group, a sec-butyl group, a tert-butyl group, an isopentyl group, an neopentyl group, a tert-pentyl group, an isohexyl group, a sec-hexyl group, a tert-hexyl group, an isoheptyl group, an sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

Among the above alkyl groups, in particular, lower alkyl groups such as a methyl group, an ethyl group, and an isopropyl group may be used.

Examples of the alkoxy group represented by $R^{C21}$, $R^{C22}$, and $R^{C23}$ in Formula (CT2) include linear and branched alkoxy groups having 1 to 10 carbon atoms, preferably 1 to 6 carbon atoms, and more preferably 1 to 4 carbon atoms.

Specific examples of the linear alkoxy group include a methoxy group, an ethoxy group, an n-propoxy group, an n-butoxy group, an n-pentyloxy group, an n-hexyloxy group, an n-heptyloxy group, an n-octyloxy group, an n-nonyloxy group, and an n-decyloxy group.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, and a tert-decyloxy group.

Among the above alkoxy groups, in particular, a methoxy group may be used.

Examples of the aryl group represented by $R^{C21}$, $R^{C22}$, and $R^{C23}$ in Formula (CT2) include aryl groups having 6 to 10 carbon atoms, preferably 6 to 9 carbon atoms, and more preferably 6 to 8 carbon atoms. Specific examples of the aryl groups include a phenyl group and a naphthyl group. Among the above aryl groups, in particular, a phenyl group may be used.

The substituent groups represented by $R^{C21}$, $R^{C22}$, and $R^{C23}$ in Formula (CT2) may further include a substituent. Examples of the substituent include the atoms and groups described above as examples, such as a halogen atom, an alkyl group, an alkoxy group, and an aryl group.

In Formula (CT2), it is particularly preferable that $R^{C21}$, $R^{C22}$, and $R^{C23}$ each independently represent a hydrogen atom or an alkyl group having 1 to 10 carbon atoms. It is more preferable that $R^{C21}$, $R^{C22}$, and $R^{C23}$ represent a hydrogen atom and $R^{C22}$ represent an alkyl group having 1 to 10 carbon atoms (in particular, a methyl group) in order to form a photosensitive layer (i.e., a charge transport layer) having high charge transportability.

Specifically, it is particularly preferable that the benzidine charge transporting material (CT2) be the charge transporting material represented by Structural Formula (CT2A) below, which is the exemplified compound (CT2-2).

(CT2A)

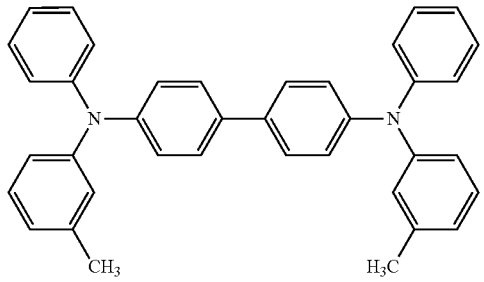

Specific examples of the charge transporting material represented by Formula (CT2) include, but are not limited to, the following compounds. Note that, hereinafter, numbers are assigned to the exemplified compounds as "exemplified compound (CT2-[Number])". Specifically, for example, the exemplified compound 15 is referred to as "exemplified compound (CT2-15)".

| No | $R^{C21}$ | $R^{C22}$ | $R^{C23}$ |
|---|---|---|---|
| CT2-1 | H | H | H |
| CT2-2 | H | 3-$CH_3$ | H |
| CT2-3 | H | 4-$CH_3$ | H |
| CT2-4 | H | 3-$C_2H_5$ | H |
| CT2-5 | H | 4-$C_2H_5$ | H |
| CT2-6 | H | 3-$OCH_3$ | H |
| CT2-7 | H | 4-$OCH_3$ | H |
| CT2-8 | H | 3-$OC_2H_5$ | H |
| CT2-9 | H | 4-$OC_2H_5$ | H |
| CT2-10 | 3-$CH_3$ | 3-$CH_3$ | H |
| CT2-11 | 4-$CH_3$ | 4-$CH_3$ | H |
| CT2-12 | 3-$C_2H_5$ | 3-$C_2H_5$ | H |
| CT2-13 | 4-$C_2H_5$ | 4-$C_2H_5$ | H |
| CT2-14 | H | H | 2-$CH_3$ |
| CT2-15 | H | H | 3-$CH_3$ |
| CT2-16 | H | 3-$CH_3$ | 2-$CH_3$ |
| CT2-17 | H | 3-$CH_3$ | 3-$CH_3$ |
| CT2-18 | H | 4-$CH_3$ | 2-$CH_3$ |
| CT2-19 | H | 4-$CH_3$ | 3-$CH_3$ |
| CT2-20 | 3-$CH_3$ | 3-$CH_3$ | 2-$CH_3$ |
| CT2-21 | 3-$CH_3$ | 3-$CH_3$ | 3-$CH_3$ |
| CT2-22 | 4-$CH_3$ | 4-$CH_3$ | 2-$CH_3$ |
| CT2-23 | 4-$CH_3$ | 4-$CH_3$ | 3-$CH_3$ |

The abbreviations used for describing the above exemplified compounds stand for the following. The numbers attached to the substituent groups each refer to the position at which the substituent group is bonded to a benzene ring.

—$CH_3$: Methyl group
—$C_2H_5$: Ethyl group
—$OCH_3$: Methoxy group
—$OC_2H_5$: Ethoxy group Only one type of the benzidine charge transporting material (CT2) may be used alone. Alternatively, two or more types of the benzidine charge transporting materials (CT2) may be used in combination.

A high-molecular charge transporting material may be used as a charge transporting material.

The high-molecular charge transporting material may be any known charge transporting material, such as poly-N-vinylcarbazole or polysilane. In particular, the polyester high-molecular charge transporting materials disclosed in, for example, Japanese Laid Open Patent Application Publication Nos. H8-176293 and H8-208820 may be used.

The total content of the charge transporting materials may be determined in accordance with the type of the top surface layer. For example, the total content of the charge transporting materials is preferably 30% by mass or more and 60% by mass or less, is more preferably 35% by mass or more and 55% by mass or less, and is further preferably 30% by mass or more and 50% by mass or less of the total mass of the top surface layer.

The above range of the content of the charge transporting materials is suitable in the case where, for example, the top surface layer is a charge transport layer.

Surface Roughness Ra

The surface roughness Ra of the top surface layer (i.e., the surface roughness Ra of the electrophotographic photosensitive member according to this exemplary embodiment) is preferably 0.13 μm or less, is more preferably 0.10 μm or less, and is further preferably 0.08 μm or less in order to increase the surface smoothness of the photosensitive member.

The lower limit for the surface roughness Ra of the top surface layer may be set to, for example, 0.05 μm or more.

The above surface roughness Ra is determined by the following method.

A part of the top surface layer is cut with a cutter or the like to prepare a specimen. The specimen is subjected to a stylus surface roughness measurement machine (e.g., "SURFCOM 1400A" produced by TOKYO SEIMITSU CO., LTD.). The measurement is conducted in accordance with JIS B 0601:1994 under the following conditions: evaluation length Ln: 10 mm, reference length L: 0.8 mm, and cut-off value: 0.8 mm.

Conductive Support

Examples of the conductive support include a metal sheet, a metal drum, and a metal belt that are made of a metal such as aluminum, copper, zinc, chromium, nickel, molybdenum, vanadium, indium, gold, or platinum or an alloy such as stainless steel. Other examples of the conductive support include a paper sheet, a resin film, and a belt on which a conductive compound such as a conductive polymer or indium oxide, a metal such as aluminum, palladium, or gold, or an alloy is deposited by coating, vapor deposition, or lamination.

The term "conductive" used herein refers to having a volume resistivity of less than $10^{13}$ Ωcm.

In the case where the electrophotographic photosensitive member is used as a component of a laser printer, the surface of the conductive support may be roughened such that the center-line average roughness Ra of the surface of the conductive support is 0.04 μm or more and 0.5 μm or less in order to reduce interference fringes formed when the photosensitive member is irradiated with a laser beam. On the other hand, it is not necessary to roughen the surface of the conductive support in order to reduce the formation of interference fringes in the case where an incoherent light source is used. However, roughening the surface of the conductive support may increase the service life of the photosensitive member by reducing the occurrence of defects caused due to the irregularities formed in the surface of the conductive support.

For roughening the surface of the conductive support, for example, the following methods may be employed: wet honing in which a suspension prepared by suspending abrasive particles in water is blown onto the surface of the conductive support; centerless grinding in which the conductive support is continuously ground with rotating grinding wheels brought into pressure contact with the conductive support; and an anodic oxidation treatment.

Another example of the roughening method is a method in which, instead of roughening the surface of the conductive support, a layer is formed on the surface of the conductive support by using a resin including conductive or semiconductive powder particles dispersed therein such that a rough surface is formed due to the particles dispersed in the layer.

In a roughening treatment using anodic oxidation, an oxidation film is formed on the surface of a conductive support made of a metal, such as aluminum, by performing anodic oxidation using the conductive support as an anode in an electrolyte solution. Examples of the electrolyte solution include a sulfuric acid solution and an oxalic acid solution. A porous anodic oxidation film formed by anodic oxidation is originally chemically active and likely to become contaminated. In addition, the resistance of the porous anodic oxidation film is likely to fluctuate widely with the environment. Accordingly, the porous anodic oxidation film may be subjected to a pore-sealing treatment in which micropores formed in the oxide film are sealed using volume expansion caused by a hydration reaction of the oxidation film in steam under pressure or in boiled water that may include a salt of a metal, such as nickel, so as to be converted into a more stable hydrous oxide film.

The thickness of the anodic oxidation film may be, for example, 0.3 μm or more and 15 μm or less. When the thickness of the anodic oxidation film falls within the above range, the anodic oxidation film may serve as a barrier to injection. Furthermore, an increase in the potential that remains on the photosensitive member after the repeated use of the photosensitive member may be limited.

The conductive support may be subjected to a treatment in which an acidic treatment liquid is used or a boehmite treatment.

The treatment in which an acidic treatment liquid is used is performed in, for example, the following manner. An acidic treatment liquid that includes phosphoric acid, chromium acid, and hydrofluoric acid is prepared. The proportions of the phosphoric acid, chromium acid, and hydrofluoric acid in the acidic treatment liquid may be, for example, 10% by mass or more and 11% by mass or less, 3% by mass or more and 5% by mass or less, and 0.5% by mass or more and 2% by mass or less, respectively. The total concentration of the above acids may be 13.5% by mass or more and 18% by mass or less. The treatment temperature may be, for example, 42° C. or more and 48° C. or less. The thickness of the resulting coating film may be 0.3 μm or more and 15 μm or less.

In the boehmite treatment, for example, the conductive support is immersed in pure water having a temperature of 90° C. or more and 100° C. or less for 5 to 60 minutes or brought into contact with steam having a temperature of 90° C. or more and 120° C. or less for 5 to 60 minutes. The thickness of the resulting coating film may be 0.1 μm or more and 5 μm or less. The coating film may optionally be subjected to an anodic oxidation treatment with an electrolyte solution in which the coating film is hardly soluble, such as adipic acid, boric acid, a boric acid salt, a phosphoric acid salt, a phthalic acid salt, a maleic acid salt, a benzoic acid salt, a tartaric acid salt, or a citric acid salt.

Undercoat Layer

The undercoat layer includes, for example, inorganic particles and a binder resin.

The inorganic particles may have, for example, a powder resistivity (i.e., volume resistivity) of $10^2$ Ωcm or more and $10^{11}$ Ωcm or less.

Among such inorganic particles having the above resistivity, for example, metal oxide particles such as tin oxide particles, titanium oxide particles, zinc oxide particles, and zirconium oxide particles are preferable and zinc oxide particles are particularly preferable.

The BET specific surface area of the inorganic particles may be, for example, 10 $m^2/g$ or more.

The volume average diameter of the inorganic particles may be, for example, 50 nm or more and 2,000 nm or less and is preferably 60 nm or more and 1,000 nm or less.

The content of the inorganic particles is preferably, for example, 10% by mass or more and 80% by mass or less and is more preferably 40% by mass or more and 80% by mass or less of the amount of binder resin.

The inorganic particles may optionally be subjected to a surface treatment. It is possible to use two or more types of inorganic particles which have been subjected to different surface treatments or have different diameters in a mixture.

Examples of an agent used in the surface treatment include a silane coupling agent, a titanate coupling agent, an aluminum coupling agent, and a surfactant. In particular, a silane coupling agent is preferable, and a silane coupling agent including an amino group is more preferable.

Examples of the silane coupling agent including an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in a mixture. For example, a silane coupling agent including an amino group may be used in combination with another type of silane coupling agent. Examples of the other type of silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

A method for treating the surface of the inorganic particles with the surface treating agent is not limited, and any known surface treatment method may be employed. Both dry process and wet process may be employed.

The amount of surface treating agent used may be, for example, 0.5% by mass or more and 10% by mass or less of the amount of inorganic particles.

The undercoat layer may include an electron accepting compound (i.e., an acceptor compound) in addition to the inorganic particles in order to enhance the long-term stability of electrical properties and carrier-blocking property.

Examples of the electron accepting compound include the following electron transporting substances: quinones, such as chloranil and bromanil; tetracyanoquinodimethanes; fluorenones, such as 2,4,7-trinitrofluorenone and 2,4,5,7-tetranitro-9-fluorenone; oxadiazoles, such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthones; thiophenes; and diphenoquinones, such as 3,3',5,5'-tetra-t-butyldiphenoquinone.

In particular, compounds including an anthraquinone structure may be used as an electron accepting compound. Examples of the compounds including an anthraquinone structure include hydroxyanthraquinones, aminoanthraquinones, and aminohydroxyanthraquinones. Specific examples thereof include anthraquinone, alizarin, quinizarin, anthrarufin, and purpurin.

The electron accepting compound may be dispersed in the undercoat layer together with the inorganic particles or deposited on the surfaces of the inorganic particles.

For attaching the electron accepting compound onto the surfaces of the inorganic particles, for example, a dry process or a wet process may be employed.

In a dry process, for example, while the inorganic particles are stirred with a mixer or the like capable of producing a large shearing force, the electron accepting compound or a solution prepared by dissolving the electron accepting compound in an organic solvent is added dropwise or sprayed together with dry air or a nitrogen gas to the inorganic particles in order to deposit the electron accepting compound on the surfaces of the inorganic particles. The addition or spraying of the electron accepting compound may be done at a temperature equal to or lower than the boiling point of the solvent used. Subsequent to the addition or spraying of the electron accepting compound, the resulting inorganic particles may optionally be baked at 100° C. or more. The temperature at which the inorganic particles are baked and the amount of time during which the inorganic particles are baked are not limited; the inorganic particles may be baked under appropriate conditions of temperature and time under which the intended electrophotographic properties are achieved.

In a wet process, for example, while the inorganic particles are dispersed in a solvent with a stirrer, an ultrasonic wave, a sand mill, an Attritor, a ball mill, or the like, the electron accepting compound is added to the dispersion liquid. After the resulting mixture has been stirred or dispersed, the solvent is removed such that the electron accepting compound is deposited on the surfaces of the inorganic particles. The removal of the solvent may be done by, for example, filtration or distillation. Subsequent to the removal of the solvent, the resulting inorganic particles may optionally be baked at 100° C. or more. The temperature at which the inorganic particles are baked and the amount of time during which the inorganic particles are baked are not limited; the inorganic particles may be baked under appropriate conditions of temperature and time under which the intended electrophotographic properties are achieved. In the wet process, moisture contained in the inorganic particles may be removed prior to the addition of the electron accepting compound. The removal of moisture contained in the inorganic particles may be done by, for example, heating the inorganic particles while being stirred in the solvent or by bringing the moisture to the boil together with the solvent.

The deposition of the electron accepting compound may be done prior or subsequent to the surface treatment of the inorganic particles with the surface treating agent. Alternatively, the deposition of the electron accepting compound and the surface treatment using the surface treating agent may be performed at the same time.

The content of the electron accepting compound may be, for example, 0.01% by mass or more and 20% by mass or less and is preferably 0.01% by mass or more and 10% by mass or less of the amount of inorganic particles.

Examples of the binder resin included in the undercoat layer include the following known materials: known high-molecular compounds such as an acetal resin (e.g., polyvinyl butyral), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a urea resin, a phenolic resin, a phenol-formaldehyde resin, a melamine resin, a urethane resin, an alkyd resin, and an epoxy resin; zirconium chelates; titanium chelates; aluminum chelates; titanium alkoxides; organotitanium compounds; and silane coupling agents.

Other examples of the binder resin included in the undercoat layer include charge transporting resins including a charge transporting group and conductive resins such as polyaniline.

Among the above binder resins, a resin insoluble in a solvent included in a coating liquid used for forming a layer on the undercoat layer may be used as a binder resin included in the undercoat layer. In particular, resins produced by reacting at least one resin selected from the group consisting of thermosetting resins (e.g., a urea resin, a phenolic resin, a phenol-formaldehyde resin, a melamine resin, a urethane resin, an unsaturated polyester resin, an alkyd resin, and an epoxy resin), polyamide resins, polyester resins, polyether resins, methacrylic resins, acrylic resins, polyvinyl alcohol resins, and polyvinyl acetal resins with a curing agent may be used.

In the case where two or more types of the above binder resins are used in combination, the mixing ratio may be set appropriately.

The undercoat layer may include various additives in order to enhance electrical properties, environmental stability, and image quality.

Examples of the additives include the following known materials: electron transporting pigments such as polycondensed pigments and azo pigments, zirconium chelates, titanium chelates, aluminum chelates, titanium alkoxides, organotitanium compounds, and silane coupling agents. The silane coupling agents, which are used in the surface treatment of the inorganic particles as described above, may also be added to the undercoat layer as an additive.

Examples of silane coupling agents that may be used as an additive include vinyltrimethoxysilane, 3-methacryloxypropyl-tris(2-methoxyethoxy)silane, 2-(3,4-epoxycyclohexyl) ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of the zirconium chelates include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelates include tetraisopropyl titanate, tetra-n-butyl titanate, butyl titanate dimer, tetra-(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxy titanium stearate.

Examples of the aluminum chelates include aluminum isopropylate, monobutoxy aluminum diisopropylate, aluminum butyrate, diethyl acetoacetate aluminum diisopropylate, and aluminum tris(ethyl acetoacetate).

The above additives may be used alone. Alternatively, two or more types of the above additives may be used in a mixture or in the form of a polycondensate.

The undercoat layer may have a Vickers hardness of 35 or more.

In order to reduce the formation of moiré fringes, the surface roughness (i.e., ten-point average roughness) of the undercoat layer may be adjusted to 1/(4n) to ½ of the wavelength λ of the laser beam used as exposure light, where n is the refractive index of the layer that is to be formed on the undercoat layer.

Resin particles and the like may be added to the undercoat layer in order to adjust the surface roughness of the undercoat layer. Examples of the resin particles include silicone resin particles and crosslinked polymethyl methacrylate resin particles. The surface of the undercoat layer may be ground in order to adjust the surface roughness of the undercoat layer. For grinding the surface of the undercoat layer, buffing, sand blasting, wet honing, grinding, and the like may be performed.

The method for forming the undercoat layer is not limited, and known methods may be employed. The undercoat layer may be formed by, for example, forming a coating film using a coating liquid prepared by mixing the above-described components with a solvent (hereinafter, this coating liquid is referred to as "undercoat layer forming coating liquid"), drying the coating film, and, as needed, heating the coating film.

Examples of the solvent used for preparing the undercoat layer forming coating liquid include known organic solvents, such as an alcohol solvent, an aromatic hydrocarbon solvent, a halogenated hydrocarbon solvent, a ketone solvent, a ketone alcohol solvent, an ether solvent, and an ester solvent.

Specific examples thereof include the following common organic solvents: methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

For dispersing the inorganic particles in the preparation of the undercoat layer forming coating liquid, for example, known equipment such as a roll mill, a ball mill, a vibrating ball mill, an Attritor, a sand mill, a colloid mill, and a paint shaker may be used.

For coating the conductive support with the undercoat layer forming coating liquid, for example, common methods such as blade coating, wire bar coating, spray coating, dip coating, bead coating, air knife coating, and curtain coating may be employed.

The thickness of the undercoat layer is preferably, for example, 15 μm or more and is more preferably 20 μm or more and 50 μm or less.

Intermediate Layer

Although not illustrated in the drawings, an intermediate layer may optionally be interposed between the undercoat layer and the photosensitive layer.

The intermediate layer includes, for example, a resin. Examples of the resin included in the intermediate layer include the following high-molecular compounds: acetal resins (e.g., polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may include an organometallic compound. Examples of the organometallic compound included in the intermediate layer include organometallic compounds containing a metal atom such as a zirconium atom, a titanium atom, an aluminum atom, a manganese atom, or a silicon atom.

The above compounds included in the intermediate layer may be used alone. Alternatively, two or more types of the above compounds may be used in a mixture or in the form of a polycondensate.

In particular, the intermediate layer may include an organometallic compound containing a zirconium atom or a silicon atom.

The method for forming the intermediate layer is not limited, and known methods may be employed. The intermediate layer may be formed by, for example, forming a coating film using an intermediate layer forming coating liquid prepared by mixing the above-described components with a solvent, drying the coating film, and, as needed, heating the coating film.

For forming the intermediate layer, common coating methods such as dip coating, push coating, wire bar coating, spray coating, blade coating, knife coating, and curtain coating may be employed.

The thickness of the intermediate layer may be, for example, 0.1 μm or more and 3 μm or less. It is possible to use the intermediate layer also as an undercoat layer.

Charge Generation Layer

The charge generation layer is, for example, a layer that includes a charge generating material and a binder resin. The charge generation layer may be a layer formed by vapor deposition of a charge generating material. The vapor deposition layer of a charge generating material may be used in the case where an incoherent light source, such as a light emitting diode (LED) or an organic electro-luminescence (EL) image array, is used.

Examples of the charge generating material include azo pigments, such as bisazo and trisazo; condensed aromatic pigments, such as dibromoanthanthrone; perylene pigments; pyrrolopyrrole pigments; phthalocyanine pigments; zinc oxide; and trigonal selenium.

Among the above charge generating materials, in particular, a metal phthalocyanine pigment or a nonmetal phthalocyanine pigment may be used in consideration of exposure to a laser beam in the near-infrared region. Specific examples of such charge generating materials include hydroxygallium phthalocyanine disclosed in, for example, Japanese Laid Open Patent Application Publication Nos. H5-263007 and H5-279591, chlorogallium phthalocyanine disclosed in, for example, Japanese Laid Open Patent Application Publication No. H5-98181, dichloro tin phthalocyanine disclosed in, for example, Japanese Laid Open Patent Application Publication Nos. H5-140472 and H5-140473, and titanyl phthalocyanine disclosed in, for example, Japanese Laid Open Patent Application Publication No. H4-189873.

Among the above charge generating materials, condensed aromatic pigments such as dibromoanthanthrone; thioindigo pigments; porphyrazines; zinc oxide; trigonal selenium; and the bisazo pigments disclosed in Japanese Laid Open Patent Application Publication Nos. 2004-78147 and 2005-181992 may be used in consideration of exposure to a laser beam in the near-ultraviolet region.

The above charge generating materials may be used also in the case where an incoherent light source such as an LED or an organic EL image array, which emits light having a center wavelength of 450 nm or more and 780 nm or less, is used. However, when the thickness of the photosensitive layer is reduced to 20 μm or less in order to increase the resolution, the strength of the electric field in the photosensitive layer may be increased. This increases the occurrence of a reduction in the amount of charge generated due to the injection of charge from the substrate, that is, image defects referred to as "black spots". This becomes more pronounced when a p-type semiconductor that is likely to induce a dark current, such as trigonal selenium or a phthalocyanine pigment, is used as a charge generating material.

In contrast, in the case where an n-type semiconductor such as a condensed aromatic pigment, a perylene pigment, or an azo pigment is used as a charge generating material, the dark current is hardly induced and the occurrence of the image defects referred to as "black spots", may be reduced even when the thickness of the photosensitive layer is reduced. Examples of an n-type charge generating material include, but are not limited to, the compounds (CG-1) to (CG-27) described in Paragraphs [0288] to [0291] of Japanese Laid Open Patent Application Publication No. 2012-155282.

Whether or not a charge generating material is n-type is determined on the basis of the polarity of the photoelectric current that flows in the charge generating material by a commonly used time-of-flight method. Specifically, a charge generating material in which electrons are more easily transmitted as carriers than holes is determined to be n-type.

The binder resin included in the charge generation layer is selected from various insulating resins. The binder resin may also be selected from organic photoconductive polymers such as poly-N-vinylcarbazole, polyvinyl anthracene, polyvinylpyrene, and polysilane.

Specific examples of the binder resin include a polyvinyl butyral resin, a polyarylate resin (e.g., polycondensate of a bisphenol and an aromatic dicarboxylic acid), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin, and a polyvinylpyrrolidone resin. The term "insulating" used herein refers to having a volume resistivity of $10^{13}$ Ωcm or more.

The above binder resins may be used alone or in a mixture of two or more.

The ratio of the amount of charge generating material to the amount of binder resin may be 10:1 to 1:10 by mass.

The charge generation layer may optionally include the additives known in the related art.

The method for forming the charge generation layer is not limited. Any known method may be employed. The charge generation layer may be formed by, for example, forming a coating film using a coating liquid prepared by mixing the above-described components with a solvent (hereinafter, this coating liquid is referred to as "charge generation layer forming coating liquid"), drying the coating film, and, as needed, heating the coating film. Alternatively, the charge generation layer may be formed by the vapor deposition of the charge generating material. The charge generation layer may be formed by the vapor deposition particularly when the charge generating material is a condensed aromatic pigment or a perylene pigment.

Examples of the solvent used for preparing the charge generation layer forming coating liquid include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. The above solvents may be used alone or in a mixture of two or more.

For dispersing particles of the charge generating material or the like in the charge generation layer forming coating liquid, for example, media dispersing machines, such as a ball mill, a vibrating ball mill, an Attritor, a sand mill, and a horizontal sand mill; and medialess dispersing machines, such as a stirrer, an ultrasonic wave disperser, a roll mill, and a high-pressure homogenizer, may be used. Specific examples of the high-pressure homogenizer include an impact-type homogenizer in which a dispersion liquid is brought into collision with a liquid or a wall under a high pressure in order to perform dispersion and a through-type homogenizer in which a dispersion liquid is passed through a very thin channel under a high pressure in order to perform dispersion.

It is effective that the average diameter of the particles of the charge generating material dispersed in the charge generation layer forming coating liquid be 0.5 μm or less, be preferably 0.3 μm or less, and be further preferably 0.15 μm or less.

For applying the charge generation layer forming coating liquid to the undercoat layer (or, the intermediate layer), for example, common coating methods such as blade coating, wire bar coating, spray coating, dip coating, bead coating, air knife coating, and curtain coating may be employed.

The temperature at which a coating film formed by applying the charge generation layer forming coating liquid to the undercoat layer (or, the intermediate layer) is dried may be, for example, 30° C. or more and 80° C. or less.

The thickness of the charge generation layer is, for example, preferably 0.1 μm or more and 5.0 μm or less and is more preferably 0.2 μm or more and 2.0 μm or less.

Charge Transport Layer

The charge transport layer is a layer including a charge transporting material, a binder resin, and the like.

In the case where the charge transport layer serves as a top surface layer, the charge transport layer may include the fluorine-containing resin particles, the fluorine-containing dispersant, the charge transporting materials, and a binder resin. When the charge transport layer is a top surface layer, the HOMO energy levels of the charge transporting materials satisfy the above-described relationship and the ratio A of the content of each charge transporting material satisfies the above condition 1.

Examples of the charge transporting materials included in the charge transport layer are the same as the above-described examples of the charge transporting materials included in the top surface layer.

Examples of the binder resin included in the charge transport layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinylcarbazole, and polysilane. Among the above binder resins, in particular, a polycarbonate resin and a polyarylate resin may be used.

The above binder resins may be used alone or in combination of two or more.

The ratio of the amounts of the charge transporting materials and the binder resin included in the charge transport layer may be 10:1 or more and 1:5 or less by mass.

Using fluorine-containing resin particles including a large amount of carboxyl groups in combination with a polycarbonate resin may reduce the dispersibility of the fluorine-containing resin particles. In particular, in the case where a polycarbonate resin including the structural unit represented by Formula (PCA) below and the structural unit represented by Formula (PCB) below (hereinafter, such a polycarbonate resin is referred to as "specific polycarbonate resin"), which contains a large amount of carbonate groups (—OC(=O)O—) per unit mole, is used, the dispersibility of the fluorine-containing resin particles may be particularly reduced. Therefore, in the case where the polycarbonate resin including the structural unit represented by Formula (PCA) below and the structural unit represented by Formula (PCB) below is used, it is preferable to use fluorine-containing resin particles including 0 to 30 carboxyl groups per million carbon atoms.

(PCA)

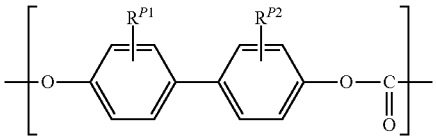

(PCB)

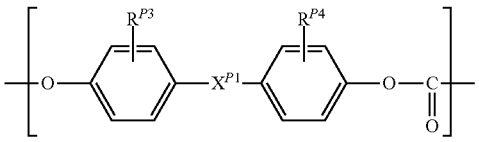

In Formulae (PCA) and (PCB), $R^{P1}$, $R^{P2}$, $R^{P3}$, and $R^{P4}$ each independently represent a hydrogen atom, a halogen atom, an alkyl group having 1 to 6 carbon atoms, a cycloalkyl group having 5 to 7 carbon atoms, or an aryl group having 6 to 12 carbon atoms; and $X^{P1}$ represents a phenylene group, a biphenylylene group, a naphthylene group, an alkylene group, or a cycloalkylene group.

Examples of the alkyl groups represented by $R^{P1}$, $R^{P2}$, $R^{P3}$, and $R^{P4}$ in Formulae (PCA) and (PCB) include linear and branched alkyl groups having 1 to 6 carbon atoms and preferably having 1 to 3 carbon atoms.

Specific examples of the linear alkyl groups include a methyl group, an ethyl group, an n-propyl group, an n-butyl group, an n-pentyl group, and an n-hexyl group.

Specific examples of the branched alkyl groups include an isopropyl group, an isobutyl group, a sec-butyl group, a tert-butyl group, an isopentyl group, a neopentyl group, a tert-pentyl group, an isohexyl group, a sec-hexyl group, and a tert-hexyl group.

Among the above alkyl groups, lower alkyl groups, such as a methyl group and an ethyl group, may be used.

Examples of the cycloalkyl groups represented by $R^{P1}$, $R^{P2}$, $R^{P3}$, and $R^{P4}$ in Formulae (PCA) and (PCB) include a cyclopentyl group, a cyclohexyl group, and a cycloheptyl group.

Examples of the aryl groups represented by $R^{P1}$, $R^{P2}$, $R^{P3}$, and $R^{P4}$ in Formulae (PCA) and (PCB) include a phenyl group, a naphthyl group, and a biphenylyl group.

Examples of the alkylene group represented by $X^{P1}$ in Formulae (PCA) and (PCB) include linear and branched alkylene groups having 1 to 12 carbon atoms, preferably having 1 to 6 carbon atoms, and more preferably having 1 to 3 carbon atoms.

Specific examples of the linear alkylene groups include a methylene group, an ethylene group, an n-propylene group, an n-butylene group, an n-pentylene group, an n-hexylene group, an n-heptylene group, an n-octylene group, an n-nonylene group, an n-decylene group, an n-undecylene group, and an n-dodecylene group.

Specific examples of the branched alkylene groups include an isopropylene group, an isobutylene group, a sec-butylene group, a tert-butylene group, an isopentylene group, a neopentylene group, a tert-pentylene group, an isohexylene group, a sec-hexylene group, a tert-hexylene group, an isoheptylene group, a sec-heptylene group, a tert-heptylene group, an isooctylene group, a sec-octylene group, a tert-octylene group, an isononylene group, a sec-nonylene group, a tert-nonylene group, an isodecylene group, a sec-decylene group, a tert-decylene group, an isoundecylene group, a sec-undecylene group, a tert-undecylene group, a neoundecylene group, an isododecylene group, a sec-dodecylene group, a tert-dodecylene group, and a neododecylene group.

Among the above alkylene groups, lower alkylene groups, such as a methylene group, an ethylene group, and a butylene group, may be used.

Examples of the cycloalkylene group represented by $X^{P1}$ in Formulae (PCA) and (PCB) include cycloalkylene group having 3 to 12 carbon atoms, preferably having 3 to 10 carbon atoms, and more preferably having 5 to 8 carbon atoms.

Specific examples of the cycloalkylene group include a cyclopropylene group, a cyclopentylene group, a cyclohexylene group, a cyclooctylene group, and a cyclododecanylene group.

Among the above cycloalkylene groups, a cyclohexylene group may be used.

The above substituent groups represented by $R^{P1}$, $R^{P2}$, $R^{P3}$, $R^{P4}$, and $X^{P1}$ in Formulae (PCA) and (PCB) may further include a substituent. Examples of the substituent include a halogen atom (e.g., a fluorine atom or a chlorine atom), an alkyl group (e.g., an alkyl group having 1 to 6 carbon atoms), a cycloalkyl group (e.g., a cycloalkyl group having 5 to 7 carbon atoms), an alkoxy group (e.g., an alkoxy group having 1 to 4 carbon atoms), and an aryl group (e.g., a phenyl group, a naphthyl group, or a biphenylyl group).

In Formula (PCA), $R^{P1}$ and $R^{P2}$ preferably each independently represent a hydrogen atom or an alkyl group having 1 to 6 carbon atoms and more preferably each independently represent a hydrogen atom.

In Formula (PCB), $R^{P3}$ and $R^{P4}$ may each independently represent a hydrogen atom or an alkyl group having 1 to 6 carbon atoms, and $X^{P1}$ may represent an alkylene group or a cycloalkylene group.

Specific examples of the specific polycarbonate resin include, but are not limited to, the following. Note that, in the exemplified compounds below, pm and pn represent a copolymerization ratio.

(PC-1)

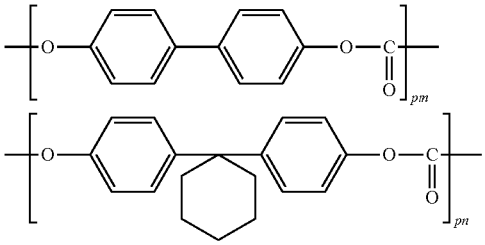

(PC-2)

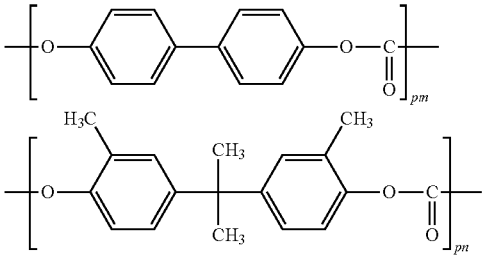

(PC-3)

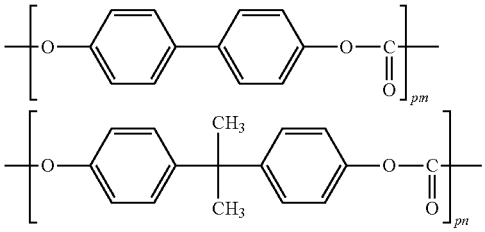

In the above specific polycarbonate resin, the content (i.e., copolymerization ratio) of the structural unit represented by Formula (PCA) may be 5 mol % or more and 95 mol % or less, is preferably 5 mol % or more and 50 mol % or less, and is further preferably 15 mol % or more and 30 mol % or less of the total amount of all the structural units constituting the polycarbonate resin.

Specifically, the copolymerization ratios (i.e., molar ratios) pm and pn in the above exemplified compounds of the specific polycarbonate resin preferably satisfy pm:pn=95:5 to 5:95, more preferably satisfy pm:pn=50:50 to 5:95, and further preferably satisfy pm:pn=15:85 to 30:70.

The ratio of the amounts of the charge transporting materials and the binder resin included in the charge transport layer may be 10:1 to 1:5 by mass.

The charge transport layer may optionally include known additives.

The method for forming the charge transport layer is not limited, and any known method may be employed. The charge transport layer may be formed by, for example, forming a coating film using a coating liquid prepared by mixing the above-described components with a solvent (hereinafter, this coating liquid is referred to as "charge transport layer forming coating liquid"), drying the coating film, and, as needed, heating the coating film.

Examples of the solvent used for preparing the charge transport layer forming coating liquid include the following common organic solvents: aromatic hydrocarbons, such as benzene, toluene, xylene, and chlorobenzene; ketones, such as acetone and 2-butanone; halogenated aliphatic hydrocarbons, such as methylene chloride, chloroform, and ethylene chloride; and cyclic and linear ethers, such as tetrahydrofuran and ethyl ether. The above solvents may be used alone or in a mixture of two or more.

For applying the charge transport layer forming coating liquid onto the surface of the charge generation layer, for example, the following common coating methods may be used: blade coating, wire bar coating, spray coating, dip coating, bead coating, air knife coating, and curtain coating.

The thickness of the charge transport layer is, for example, preferably 5 μm or more and 50 μm or less and is more preferably 10 μm or more and 30 μm or less.

Protection Layer

A protection layer may optionally be disposed on the photosensitive layer.

The protection layer is provided in order to, for example, reduce the chemical change of the photosensitive layer which may occur during charging and increase the mechanical strength of the photosensitive layer. Therefore, the protection layer may be a layer composed of a cured film (i.e., a crosslinked film).

In an electrophotographic photosensitive member including the protection layer, the protection layer serves as a top surface layer. Therefore, in an electrophotographic photosensitive member including the protection layer, the protection layer includes the fluorine-containing resin particles, the fluorine-containing dispersant, and the charge transporting materials. The HOMO energy levels of the charge transporting materials satisfy the above-described relationship. Furthermore, the ratio A of the content of each charge transporting material satisfies the above condition 1.

Examples of the protection layer composed of a cured film include the layers described in 1) and 2) below.

(1) a layer composed of a film formed by curing a composition including a reactive group-containing charge transporting material that includes a reactive group and a charge transporting skeleton in the same molecule, that is, a layer including a polymer or a crosslinked product of the reactive group-containing charge transporting material.

(2) a layer composed of a film formed by curing a composition including a nonreactive charge transporting material and a reactive group-containing non-charge transporting material that does not include a charge transporting skeleton and includes a reactive group, that is, a layer including a polymer or a crosslinked product of the nonreactive charge transporting material with the reactive group-containing non-charge transporting material.

Examples of the reactive group included in the reactive group-containing charge transporting material include the following known reactive groups: a chain-polymerization group; an epoxy group; a —OH group; a —OR group, where R is an alkyl group; a $—NH_2$ group; a —SH group; a —COOH group; and a $—SiR^{Q1}{}_{3-Qn}(OR^{Q2})_{Qn}$ group, where $R^{Q1}$ represents a hydrogen atom, an alkyl group, an aryl group, or a substituted aryl group, $R^{Q2}$ represents a hydrogen atom, an alkyl group, or a trialkylsilyl group, and Qn is an integer of 1 to 3.

The chain-polymerization group is not limited, and may be any functional group capable of inducing radical polymerization. Examples of the chain-polymerization group include functional groups including at least a carbon double bond. Specific examples of the chain-polymerization group include functional groups including at least one selected from a vinyl group, a vinyl ether group, a vinylthioether group, a styryl group (vinylphenyl group), an acryloyl group, a methacryloyl group, and derivatives of the above groups. In particular, a chain-polymerization group including at least one selected from a vinyl group, a styryl group (vinylphenyl group), an acryloyl group, a methacryloyl group, and derivatives of the above groups may be used, because such a chain-polymerization group has high reactivity.

The charge transporting skeleton of the reactive group-containing charge transporting material is not limited and may be any charge transporting skeleton having a structure known in the field of electrophotographic photosensitive members. Examples of such a charge transporting skeleton include skeletons that are derived from nitrogen-containing hole transporting compounds, such as triarylamines, benzidines, and hydrazones and conjugated with a nitrogen atom. Among such skeletons, in particular, a triarylamine skeleton may be used.

The above-described reactive group-containing charge transporting material that includes the reactive group and the charge transporting skeleton, the nonreactive charge transporting material, and the reactive group-containing non-charge transporting material may be selected from known materials.

The protection layer may optionally include known additives.

The method for forming the protection layer is not limited, and known methods may be used. The protection layer may be formed by, for example, forming a coating film using a coating liquid prepared by mixing the above-described components in a solvent (hereinafter, this coating liquid is referred to as "protection layer forming coating liquid"), drying the coating film, and, as needed, curing the coating film by heating or the like.

Examples of the solvent used for preparing the protection layer forming coating liquid include aromatic solvents, such as toluene and xylene; ketone solvents, such as methyl ethyl ketone, methyl isobutyl ketone, and cyclohexanone; ester solvents, such as ethyl acetate and butyl acetate; ether solvents, such as tetrahydrofuran and dioxane; cellosolve solvents, such as ethylene glycol monomethyl ether; and alcohol solvents, such as isopropyl alcohol and butanol. The above solvents may be used alone or in a mixture of two or more.

The protection layer forming coating liquid may be prepared without using a solvent.

For applying the protection layer forming coating liquid on the photosensitive layer (e.g., the charge transport layer), for example, the following common methods may be used: dip coating, push coating, wire bar coating, spray coating, blade coating, knife coating, and curtain coating.

The thickness of the protection layer is preferably, for example, 1 μm or more and 20 μm or less and is more preferably 2 μm or more and 10 μm or less.

Single-Layer Photosensitive Layer

A single-layer photosensitive layer (i.e., charge generation and transport layer) includes, for example, a charge generating material, a charge transporting material, and, as needed, a binder resin and known additives.

In the case where the single-layer photosensitive layer serves as a top surface layer, the single-layer photosensitive layer may include the fluorine-containing resin particles, the fluorine-containing dispersant, the charge transporting materials, the charge generating material, and the binder resin. In the single-layer photosensitive layer serving as a top surface layer, the HOMO energy levels of the charge transporting materials satisfy the above-described relationship and the ratio A of the content of each charge transporting material satisfies the above condition 1.

The above materials included in the single-layer photosensitive layer are the same as those described in Charge Generation Layer and Charge Transport Layer above.

The content of the charge generating material in the single-layer photosensitive layer is preferably 0.1% by mass or more and 10% by mass or less and is more preferably 0.8% by mass or more and 5% by mass or less of the total solid content of the single-layer photosensitive layer. The content of the charge transporting material in the single-layer photosensitive layer may be 5% by mass or more and 50% by mass or less of the total solid content of the single-layer photosensitive layer.

The single-layer photosensitive layer may be formed by the same method as in the formation of the charge generation layer and the charge transport layer.

The thickness of the single-layer photosensitive layer is, for example, preferably 5 μm or more and 50 μm or less and is more preferably 10 μm or more and 40 μm or less.

Activation Energy

The activation energy of the electrophotographic photosensitive member according to this exemplary embodiment is preferably 0.35 eV or less and is more preferably 0.2 eV or more and 0.35 eV or less in order to reduce the fluctuations in charge transportability caused by the discharge products and limit the potential increase which may occur after exposure when the electrophotographic photosensitive member is used over a prolonged period of time.

The activation energy of the electrophotographic photosensitive member is determined by the following method.

The activation energy of the electrophotographic photosensitive member is determined by measuring thermally stimulated current (TSC).

Specifically, a state in which traps are accumulated is created by irradiation of ultraviolet radiation at −150° C. using an electron trap measurement system "TS-FETT" produced by Rigaku Corporation. Subsequently, heating is performed from −150° C. to 50° C. at 10° C./min and the current that flows during heating is measured to determine activation energy.

Image Forming Apparatus and Process Cartridge

An image forming apparatus according to this exemplary embodiment includes an electrophotographic photosensitive member; a charging unit that charges the surface of the electrophotographic photosensitive member; a unit that forms an electrostatic latent image on the charged surface of the electrophotographic photosensitive member (hereinafter, this unit is referred to as "electrostatic latent image forming unit"); a developing unit that develops the electrostatic latent image formed on the surface of the electrophotographic photosensitive member with a developer including a toner in order to form a toner image; and a transfer unit that transfers the toner image onto the surface of a recording medium. The electrophotographic photosensitive member is the electrophotographic photosensitive member according to the above-described exemplary embodiment.

The image forming apparatus according to this exemplary embodiment may be implemented as any of the following known image forming apparatuses: an image forming apparatus that includes a fixing unit that fixes the toner image transferred on the surface of the recording medium; a direct-transfer image forming apparatus that directly transfers a toner image formed on the surface of the electrophotographic photosensitive member onto the surface of a recording medium; an intermediate-transfer image forming apparatus that transfers a toner image formed on the surface of the electrophotographic photosensitive member onto the surface of an intermediate transfer body (this process is referred to as "first transfer") and further transfers the toner image transferred on the surface of the intermediate transfer body onto the surface of a recording medium (this process is referred to as "second transfer"); an image forming apparatus that includes a cleaning unit that cleans the surface of the electrophotographic photosensitive member after the toner image has been transferred and before the electrophotographic photosensitive member is charged; an image forming apparatus that includes an erasing unit that irradiates, with erasing light, the surface of the electrophotographic photosensitive member after the toner image has been transferred and before the electrophotographic photosensitive member is charged in order to erase charge; and an image forming apparatus that includes an electrophotographic photosensitive member heating member that heats the electrophotographic photosensitive member in order to lower the relative temperature.

In the intermediate-transfer image forming apparatus, the transfer unit includes, for example, an intermediate transfer body onto which a toner image is transferred, a first transfer unit that transfers a toner image formed on the surface of the electrophotographic photosensitive member onto the surface of the intermediate transfer body (first transfer), and a second transfer unit that transfers the toner image transferred on the surface of the intermediate transfer body onto the surface of a recording medium (second transfer).

The image forming apparatus according to this exemplary embodiment may be either a dry-developing image forming apparatus or a wet-developing image forming apparatus in which a liquid developer is used for developing images.

In the image forming apparatus according to this exemplary embodiment, for example, a portion including the electrophotographic photosensitive member may have a cartridge structure, that is, may be a process cartridge, which is detachably attachable to the image forming apparatus. The process cartridge may include, for example, the electrophotographic photosensitive member according to the above-described exemplary embodiment. The process cartridge may further include, for example, at least one component selected from the group consisting of the charging unit, the electrostatic latent image forming unit, the developing unit, and the transfer unit.

An example of the image forming apparatus according to this exemplary embodiment is described below. However, the image forming apparatus is not limited to this. Hereinafter, only the components illustrated in the drawings are described, and the descriptions of the other components are omitted.

Figure 2:
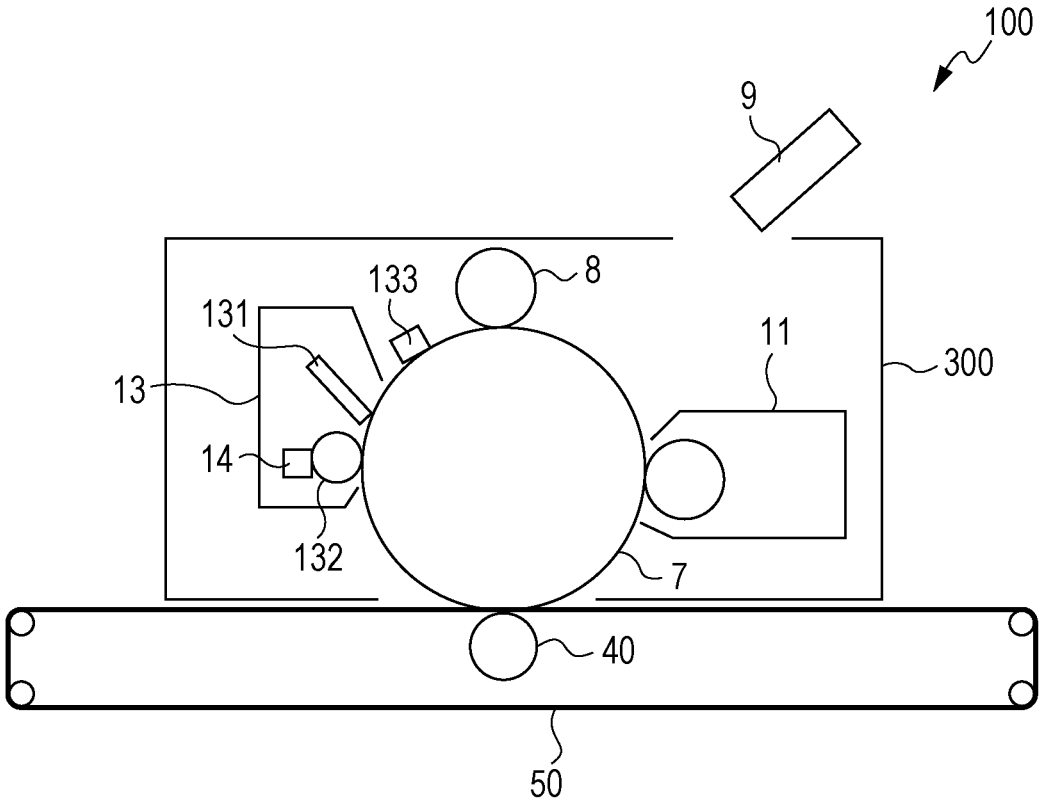
FIG. 2 is a schematic diagram illustrating an example of an image forming apparatus according to an exemplary embodiment.

FIG. 2 schematically illustrates an example of the image forming apparatus according to this exemplary embodiment.

As illustrated in FIG. 2, an image forming apparatus 100 according to this exemplary embodiment includes a process cartridge 300 including an electrophotographic photosensitive member 7, an exposure device 9 (an example of the electrostatic latent image forming unit), a transfer device 40 (i.e., a first transfer device), and an intermediate transfer body 50. In the image forming apparatus 100, the exposure device 9 is arranged such that the electrophotographic photosensitive member 7 is exposed to light emitted by the exposure device 9 through an aperture formed in the process cartridge 300; the transfer device 40 is arranged to face the electrophotographic photosensitive member 7 across the intermediate transfer body 50; and the intermediate transfer body 50 is arranged such that a part of the intermediate transfer body 50 comes into contact with the electrophotographic photosensitive member 7. Although not illustrated in FIG. 2, the image forming apparatus 100 also includes a second transfer device that transfers a toner image transferred on the intermediate transfer body 50 onto a recording medium, such as paper. The intermediate transfer body 50, the transfer device 40 (i.e., a first transfer device), and the second transfer device (not illustrated) correspond to an example of the transfer unit.

The process cartridge 300 illustrated in FIG. 2 includes the electrophotographic photosensitive member 7, a charging device 8 (an example of the charging unit), a developing device 11 (an example of the developing unit), and a cleaning device 13 (an example of the cleaning unit), which are integrally supported inside a housing. The cleaning device 13 includes a cleaning blade 131 (an example of the cleaning member), which is arranged to come into contact with the surface of the electrophotographic photosensitive member 7. The cleaning member is not limited to the cleaning blade 131 and may be a conductive or insulative fibrous member. The conductive or insulative fibrous member may be used alone or in combination with the cleaning blade 131.

The image forming apparatus illustrated in FIG. 2 includes a roller-like, fibrous member 132 with which a lubricant 14 is fed onto the surface of the electrophotographic photosensitive member 7 and a flat-brush-like, fibrous member 133 that assists cleaning. However, the image forming apparatus illustrated in FIG. 2 is merely an example, and the fibrous members 132 and 133 are optional.

The components of the image forming apparatus according to this exemplary embodiment are described below.

Charging Device

Examples of the charging device 8 include contact chargers that include a charging roller, a charging brush, a charging film, a charging rubber blade, or a charging tube that are conductive or semiconductive; contactless roller chargers; and known chargers such as a scorotron charger and a corotron charger that use corona discharge.

Exposure Device

The exposure device 9 may be, for example, an optical device with which the surface of the electrophotographic photosensitive member 7 can be exposed to light emitted by a semiconductor laser, an LED, a liquid-crystal shutter, or the like in a predetermined image pattern. The wavelength of the light source is set to fall within the range of the spectral sensitivity of the electrophotographic photosensitive member. Although common semiconductor lasers have an oscillation wavelength in the vicinity of 780 nm, that is, the near-infrared region, the wavelength of the light source is not limited to this; lasers having an oscillation wavelength of about 600 to 700 nm and blue lasers having an oscillation wavelength of 400 nm or more and 450 nm or less may also be used. For forming color images, surface-emitting lasers capable of emitting multi beam may be used as a light source.

Developing Device

The developing device 11 may be, for example, a common developing device that develops latent images with a developer in a contacting or noncontacting manner. The developing device 11 is not limited and may be selected from developing devices having the above functions in accordance with the purpose. Examples of the developing device include known developing devices capable of depositing a one- or two-component developer on the electrophotographic photosensitive member 7 with a brush, a roller, or the like. In particular, a developing device including a developing roller on which a developer is deposited may be used.

The developer included in the developing device 11 may be either a one-component developer including only a toner or a two-component developer including a toner and a carrier. The developer may be magnetic or nonmagnetic. Known developers may be used as a developer included in the developing device 11.

Cleaning Device

The cleaning device 13 is a cleaning-blade-type cleaning device including a cleaning blade 131.

The cleaning device 13 is not limited to a cleaning-blade-type cleaning device and may be a fur-brush-cleaning-type cleaning device or a cleaning device that performs cleaning during development.

Transfer Device

Examples of the transfer device 40 include contact transfer chargers including a belt, a roller, a film, a rubber blade, or the like; and known transfer chargers which use corona discharge, such as a scorotron transfer charger and a corotron transfer charger.

Intermediate Transfer Body

The intermediate transfer body 50 is a belt-like intermediate transfer body, that is, an intermediate transfer belt, including polyimide, polyamideimide, polycarbonate, polyarylate, polyester, a rubber, or the like that is made semiconductive. The intermediate transfer body is not limited to a belt-like intermediate transfer body and may be a drum-like intermediate transfer body.

Figure 3:
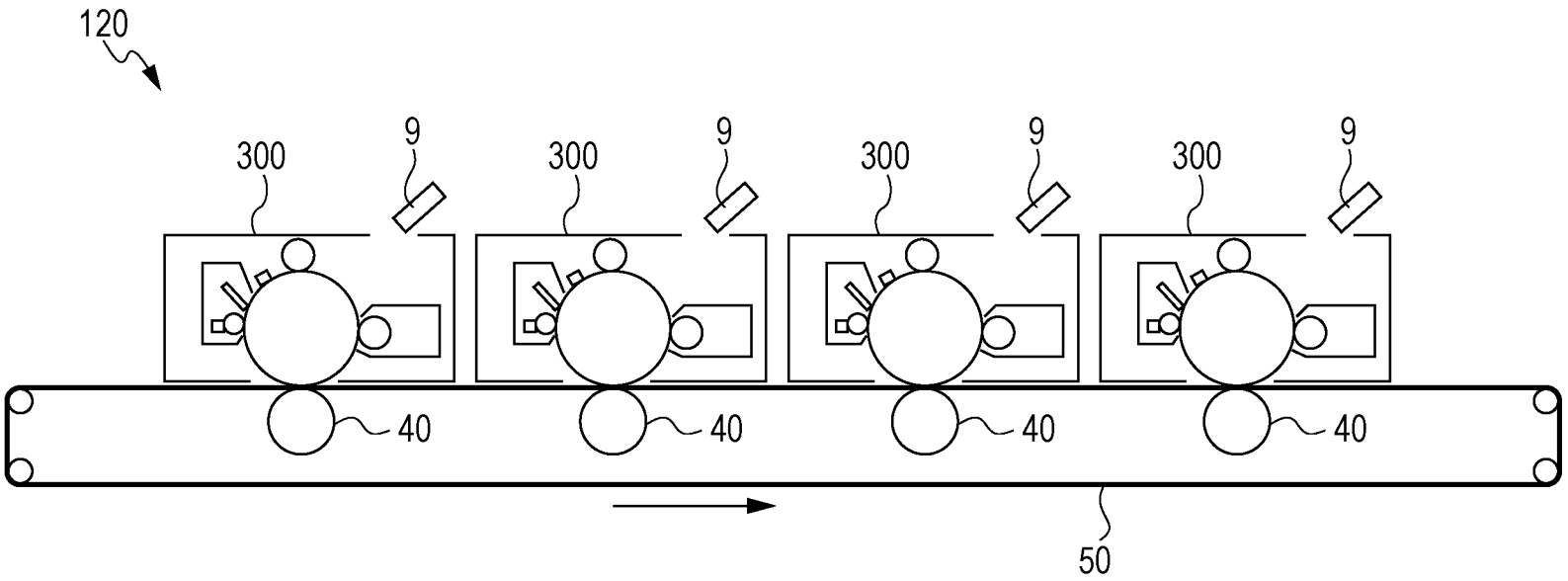
FIG. 3 is a schematic diagram illustrating another example of the image forming apparatus according to the exemplary embodiment.

FIG. 3 schematically illustrates another example of the image forming apparatus according to this exemplary embodiment.

The image forming apparatus 120 illustrated in FIG. 3 is a tandem, multi-color image forming apparatus including four process cartridges 300. In the image forming apparatus 120, the four process cartridges 300 are arranged in parallel to one another on an intermediate transfer body 50, and one electrophotographic photosensitive member is used for one color. The image forming apparatus 120 has the same structure as the image forming apparatus 100 except that the image forming apparatus 120 is tandem.

EXAMPLES

The exemplary embodiments are described in detail below with reference to Examples. The exemplary embodiments are not limited by Examples below. In the following description, all "part" and "%" are on a mass basis unless otherwise specified.

Preparation of Electrophotographic Photosensitive Member

Example 1

Formation of Undercoat Layer

With 100 parts by mass of zinc oxide particles "MZ 300" produced by TAYCA CORPORATION (volume average primary particle size: 35 nm), 10 parts by mass of a 10-mass % toluene solution of N-2-(aminoethyl)-3-aminopropyltriethoxysilane, which serves as a silane coupling agent, and 200 parts by mass of toluene are mixed. The resulting mixture is stirred and then refluxed for two hours. The toluene is distilled off under reduced pressure (10 mmHg). Subsequently, a burn-in treatment is performed at 135° C. for 2 hours to perform the surface treatment of zinc oxide with a silane coupling agent.

With 33 parts by mass of the surface-treated zinc oxide particles, 6 parts by mass of blocked isocyanate "Sumidur 3175" produced by Sumitomo Bayer Urethane Co., Ltd., 1 part by mass of the compound represented by Structural Formula (AK-1) below, and 25 parts by mass of methyl ethyl ketone are mixed for 30 minutes. To the resulting mixture, 5 parts by mass of a butyral resin "S-LEC BM-1" produced by SEKISUI CHEMICAL CO., LTD., 3 parts by mass of silicone beads "Tospearl 120" produced by Momentive Performance Materials Inc., and 0.01 parts by mass of Dow Corning Toray Silicone Oil "SH29PA" produced by Dow Corning Toray Silicone Co., Ltd., which serves as a leveling agent, are added. The mixture is dispersed for 1.8 hours (i.e., dispersion time is set to 1.8 hours) with a sand mill to form an undercoat layer forming coating liquid.

(AK-1)

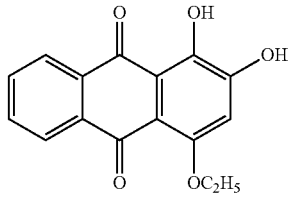

The undercoat layer forming coating liquid is applied to an aluminum support (i.e., a conductive support) having a diameter of 47 mm, a length of 357 mm, and a thickness of 1 mm by dip coating. The resulting coating film is cured by drying at 180° C. for 30 minutes to form an undercoat layer having a thickness of 25 μm.

Formation of Charge Generation Layer

A mixture of a hydroxygallium phthalocyanine pigment (Type-V hydroxygallium phthalocyanine pigment having a diffraction peak at, at least, Bragg angles (2θ±0.2°) of 7.3°, 16.0°, 24.9°, and 28.0° in an X-ray diffraction spectrum measured with the CuKα radiation; the hydroxygallium phthalocyanine pigment has a maximum peak wavelength at 820 nm in an absorption spectrum that covers a wavelength range of 600 nm or more and 900 nm or less, an average particle diameter of 0.12 μm, a maximum particle diameter of 0.2 μm, and a specific surface area of 60 $m^2/g$) used as a charge generating material, a vinyl chloride-vinyl acetate copolymer resin ("VMCH" produced by NUC) used as a binder resin, and n-butyl acetate is charged into a glass bottle having a volume of 100 mL together with glass beads having a diameter of 1.0 mm at a filling ratio of 50%. The mixture is dispersed for 2.5 hours with a paint shaker to form a charge generation layer forming coating liquid. The amount of hydroxygallium phthalocyanine pigment is set to 55.0% by volume of the amount of mixture of the hydroxygallium phthalocyanine pigment and the vinyl chloride-vinyl acetate copolymer. The concentration of the solid component in the dispersion liquid is set to 6.0% by mass. In the calculation of content, the specific gravity of the hydroxygallium phthalocyanine pigment is considered 1.606 $g/cm^3$, and the specific gravity of the vinyl chloride-vinyl acetate copolymer resin is considered 1.35 $g/cm^3$.

The charge generation layer forming coating liquid is applied to the undercoat layer by dip coating. The resulting coating film is cured by drying at 40° C. for 5 minutes to form a charge generation layer having a thickness of 0.20 μm.

Formation of Charge Transport Layer

In 500 parts by mass of tetrahydrofuran, 19 parts by mass of the CTM1 below and 19 parts by mass of the CTM2 below which are used as charge transporting materials, 54 parts by mass of a specific polycarbonate resin represented by Formula (PC-1) above (pm:pn=25:75, viscosity average molecular weight: 50,000) used as a binder resin, 7 parts by mass of PTFE particles 1 used as fluorine-containing resin particles, 0.3 parts by mass of "GF400" produced by Toagosei Co., Ltd. (surfactant including at least a methacrylate including a fluoroalkyl group as a polymerization component) used as a fluorine-containing dispersant, and 0.7 parts by mass of a hindered phenol antioxidant (molecular weight: 775) used as an antioxidant are dissolved. The resulting solution is treated with a high-pressure homogenizer 10 times to form a charge transport layer forming coating liquid.

The charge transport layer forming coating liquid is applied to the charge generation layer by dip coating. The resulting coating film is dried at 140° C. for 40 minutes to form a charge transport layer having a thickness of 40 μm.

Hereby, an electrophotographic photosensitive member including a charge transport layer serving as a top surface layer is prepared.

Examples 2 to 15

An electrophotographic photosensitive member is prepared as in Example 1, except that, in the preparation of the charge transport layer forming coating liquid in Example 1, the charge transporting materials, the fluorine-containing resin particles, and the fluorine-containing dispersant are changed as described in Table 1 and a charge transport layer is formed using this coating liquid.

Comparative Examples 1 to 4

An electrophotographic photosensitive member is prepared as in Example 1, except that, in the preparation of the charge transport layer forming coating liquid in Example 1, the types, etc. of the charge transporting materials used are changed as described in Table 1 and a charge transport layer is formed using this coating liquid.

Materials

Fluorine-Containing Resin Particles

Details of the fluorine-containing resin particles listed in Table 1 are described below.

PTFE particles 1 and PTFE particles 2 both have an average size of 0.2 μm or more and 4.5 μm or less.

PTFE Particles 1

Into a bag made of barrier nylon, 100 parts by mass of a commercial homopolytetrafluoroethylene fine powder (standard specific gravity measured in accordance with ASTM D 4895 (2004):2.175) and 2.4 parts by mass of ethanol used as an additive are charged. The entirety of the bag is purged with nitrogen such that the oxygen concentration is reduced to 10%. Subsequently, the bag is irradiated with 150 kGy of cobalt-60 γ-radiation at room temperature. Hereby, a low-molecular-weight polytetrafluoroethylene powder is prepared. This powder is pulverized to form fluorine-containing resin particles. The number of carboxyl groups included in the fluorine-containing resin particles per million carbon atoms is 30.

PTFE Particles 2

Into a bag made of barrier nylon, 100 parts by mass of a commercial homopolytetrafluoroethylene fine powder (standard specific gravity measured in accordance with ASTM D 4895 (2004):2.175) and 2.4 parts by mass of ethanol used as an additive are charged. The entirety of the bag is purged with nitrogen such that the oxygen concentration is reduced to 15%. Subsequently, the bag is irradiated with 150 kGy of cobalt-60 γ-radiation at room temperature. Hereby, a low-molecular-weight polytetrafluoroethylene powder is prepared. This powder is pulverized to form fluorine-containing resin particles. The number of carboxyl groups included in the fluorine-containing resin particles per million carbon atoms is 40.

Charge Transporting Materials

Details of the charge transporting materials listed in Table 1 are described below.

CTM1 (benzidine charge transporting material, a charge transporting material represented by Structural Formula (CT2A)), HOMO energy level: 5.45 eV CTM2 (butadiene charge transporting material, a charge transporting material represented by Structural Formula (CT1A)), HOMO energy level: 5.39 eV CTM3 (benzidine charge transporting material having the structure described below), HOMO energy level: 5.32 eV CTM4 (butadiene charge transporting material having the structure described below), HOMO energy level: 5.28 eV CTM5 (having the structure described below), HOMO energy level: 5.09 eV

CTM3

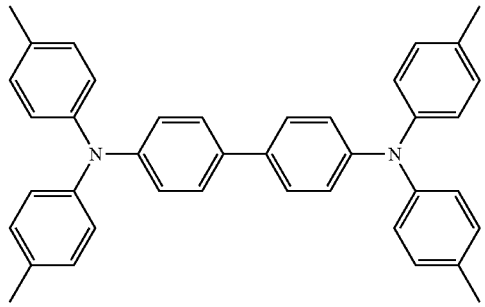

CTM4

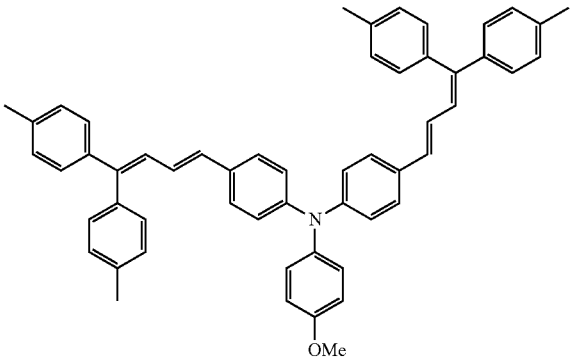

-continued

CTM5

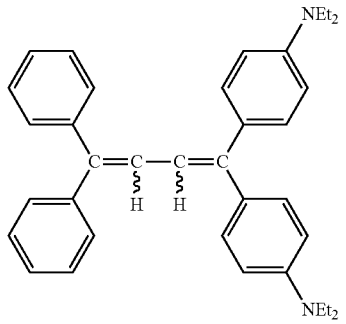

Evaluation of Fluctuations in Charge Transportability

The electrophotographic photosensitive members prepared in Examples and Comparative Examples above are evaluated in terms of fluctuations in charge transportability by the following method.

Specifically, a charging roller is abut against an electrophotographic photosensitive member that is to be evaluated. A voltage of 2 kV is applied to the electrophotographic photosensitive member to apply a stress to the electrophotographic photosensitive member and produce discharge products. Subsequently, the potential of the surface of the electrophotographic photosensitive member is measured at 2 mJ/cm$^2$ and a speed of 35 rpm. The difference in potential between the portion to which the stress has been applied and a portion to which the stress has not been applied (in Table 1, this potential difference is referred to as "difference in post-exposure potential after discharge stress") is used as an index of the fluctuations in charge transportability. The smaller the above potential difference, the greater the reduction in fluctuations in charge transportability.

Note that the above surface potential is measured with a high-accuracy surface electrometer "Model 334" produced by TREK.

Evaluation of Increase in Charge

The electrophotographic photosensitive members prepared in Examples and Comparative Examples above are evaluated in terms of increase in charge by the following method.

An evaluation image forming apparatus that is based on "DocuCentre-IV C2263" produced by Fuji Xerox Co., Ltd. and includes a surface electrometer (high-accuracy surface electrometer "Model 334" produced by TREK) arranged to face an electrophotographic photosensitive member, instead of the developing device, is prepared.

An electrophotographic photosensitive member that is to be evaluated is attached to the evaluation image forming apparatus. The difference between the post-exposure potential measured at 5 mJ/cm$^2$ and a speed of 67 rpm under the conditions of temperature of 28° C. and a humidity of 85% RH and the post-exposure potential measured at 5 mJ/cm$^2$ and a speed of 67 rpm after the evaluation image forming apparatus has been driven for 5 days at 10 kPV/day is used as a property value associated with the increase in charge.

In the case where the difference is 15 V or more, the electrophotographic photosensitive member is considered unacceptable in terms of practical application in consideration of impact on image quality.

Evaluation of Electrification Characteristic

The photosensitive members are evaluated in terms of electrification characteristic in the following manner.

An evaluation image forming apparatus including an electrophotographic photosensitive member that is to be evaluated is used. After the surface potential after charging has been set to −700 V, a solid halftone image having an image density of 30% is formed on 70,000 A4-paper sheets in a high temperature, high humidity environment (temperature: 28° C., humidity: 85% RH). The surface potential of the electrophotographic photosensitive member is measured with a surface electrometer (high-accuracy surface electrometer "Model 334" produced by TREK). The evaluation is made on the basis of the following evaluation standards.

3: Surface potential is −700 V or more and less than −660 V

2: Surface potential is −660 V or more and less than −640 V

1: Surface potential is −640 V or more

TABLE 1

| | Fluorine-containing resin particles | | | | Charge transporting material | | | |
|---|---|---|---|---|---|---|---|---|
| | Type | Number of carboxyl groups per $10^6$ carbon atoms | Content [mass %] | Content of fluorine-containing dispersant [mass %] | First | Second | Third | HOMO energy level difference |
| Example 1 | PTFE1 | 30 | 7 | 0.3 | CTM1 | CTM2 | — | 0.06 |
| Example 2 | PTFE1 | 30 | 7 | 0.3 | CTM1 | CTM2 | CTM3 | 0.06, 0.07 |
| Example 3 | PTFE1 | 30 | 7 | 0.3 | CTM1 | CTM2 | CTM4 | 0.06, 0.11 |
| Example 4 | PTFE1 | 30 | 7 | 0.3 | CTM1 | CTM2 | CTM3 | 0.06, 0.07 |
| Example 5 | PTFE1 | 30 | 7 | 0.3 | CTM1 | CTM2 | CTM3 | 0.06, 0.07 |
| Example 6 | PTFE1 | 30 | 7 | 0.3 | CTM1 | CTM2 | CTM3 | 0.06, 0.07 |
| Example 7 | PTFE1 | 30 | 7 | 0.3 | CTM1 | CTM2 | CTM3 | 0.06, 0.07 |
| Example 8 | PTFE1 | 30 | 7 | 0.2 | CTM1 | CTM2 | — | 0.06 |
| Example 9 | PTFE1 | 30 | 7 | 0.25 | CTM1 | CTM2 | — | 0.06 |
| Example 10 | PTFE1 | 30 | 7 | 0.4 | CTM1 | CTM2 | — | 0.06 |
| Example 11 | PTFE1 | 30 | 7 | 0.45 | CTM1 | CTM2 | — | 0.06 |
| Example 12 | PTFE1 | 30 | 7 | 0.3 | CTM1 | CTM2 | — | 0.06 |
| Example 13 | PTFE1 | 30 | 7 | 0.3 | CTM1 | CTM3 | — | 0.13 |
| Example 14 | PTFE1 | 30 | 7 | 0.3 | CTM2 | CTM4 | — | 0.11 |
| Example 15 | PTFE2 | 40 | 7 | 0.3 | CTM1 | CTM2 | — | 0.06 |
| Comparative example 1 | PTFE1 | 30 | 7 | 0.3 | CTM1 | — | — | — |
| Comparative example 2 | PTFE1 | 30 | 7 | 0.3 | CTM1 | CTM2 | — | 0.06 |

TABLE 1-continued

| | | | | | | | | |
|---|---|---|---|---|---|---|---|---|
| Comparative example 3 | PTFE1 | 30 | 7 | 0.3 | CTM1 | CTM2 | CTM5 | 0.06, 0.30 |
| Comparative example 4 | PTFE1 | 30 | 7 | 0.3 | CTM1 | CTM2 | CTM4 | 0.06, 0.11 |

| | Charge transporting material | | | | | Evaluations | | |
|---|---|---|---|---|---|---|---|---|
| | Ratio A of amount of each charge transporting material to total amount of charge transporting materials | | | Total content | Activation energy | Difference in post-exposure potential after discharge | Increase in amount of charge | Electrification |
| | First | Second | Third | [mass %] | [eV] | stress [V] | [V] | characteristic |
| Example 1 | 1/2 | 1/2 | — | 38 | 0.33 | 9 | 11 | 3 |
| Example 2 | 1/3 | 1/3 | 1/3 | 38 | 0.30 | 5 | 5 | 3 |
| Example 3 | 1/3 | 1/3 | 1/3 | 38 | 0.32 | 8 | 10 | 3 |
| Example 4 | 4/15 | 5/15 | 6/15 | 38 | 0.31 | 7 | 8 | 3 |
| Example 5 | 6/15 | 5/15 | 4/15 | 38 | 0.31 | 7 | 8 | 3 |
| Example 6 | 3/12 | 5/12 | 4/12 | 38 | 0.32 | 8 | 10 | 3 |
| Example 7 | 4/12 | 3/12 | 5/12 | 38 | 0.32 | 8 | 10 | 3 |
| Example 8 | 1/2 | 1/2 | — | 38 | 0.30 | 5 | 5 | 3 |
| Example 9 | 1/2 | 1/2 | — | 38 | 0.32 | 8 | 10 | 3 |
| Example 10 | 1/2 | 1/2 | — | 38 | 0.34 | 9 | 14 | 3 |
| Example 11 | 1/2 | 1/2 | — | 38 | 0.35 | 10 | 15 | 3 |
| Example 12 | 1/2 | 1/2 | — | 60 | 0.32 | 8 | 10 | 3 |
| Example 13 | 1/2 | 1/2 | — | 38 | 0.35 | 10 | 15 | 3 |
| Example 14 | 1/2 | 1/2 | — | 38 | 0.34 | 9 | 14 | 3 |
| Example 15 | 1/2 | 1/2 | — | 38 | 0.33 | 9 | 11 | 2 |
| Comparative example 1 | 1/1 | — | — | 38 | 0.39 | 20 | 30 | 3 |
| Comparative example 2 | 7/10 | 3/10 | — | 38 | 0.37 | 14 | 20 | 3 |
| Comparative example 3 | 1/3 | 1/3 | 1/3 | 38 | 0.38 | 19 | 27 | 3 |
| Comparative example 4 | 5/24 | 11/24 | 8/24 | 38 | 0.36 | 12 | 16 | 3 |

The results described in Table 1 confirm that the electrophotographic photosensitive members prepared in Examples above reduce fluctuations in charge transportability caused by discharge products and limit an increase in potential which is caused subsequent to exposure when the electrophotographic photosensitive member is used over a prolonged period of time, compared with the electrophotographic photosensitive members prepared in Comparative Examples.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrophotographic photosensitive member comprising:

a conductive support; and a photosensitive layer disposed on the conductive support, wherein a top surface layer of the electrophotographic photosensitive member includes fluorine-containing resin particles, a fluorine-containing dispersant, and two or more charge transporting materials, wherein, when the charge transporting materials are listed in order of decreasing HOMO energy levels, a difference in HOMO energy level between each adjacent two of the charge transporting materials is more than 0 eV and 0.2 eV or less, wherein a percentage ratio A of an amount of each of the charge transporting materials to a total amount of the charge transporting materials satisfies a condition 1 below, $$[(100/N)-(100/N\times0.3)]\%\leq A\leq[(100/N)+(100/N\times0.3)]\% \quad \text{Condition 1}$$

where, in the condition 1, N represents a number of types of the charge transporting materials included in the top surface layer, and wherein the charge transporting materials include a compound represented by Formula (CT1) and/or a compound represented by Formula (CT2), (CT1)

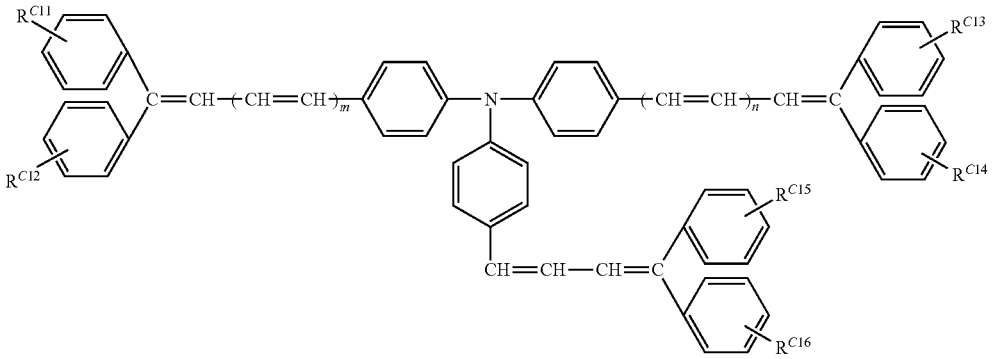

where, in Formula (CT1), $R^{C11}$, $R^{C12}$, $R^{C13}$, $R^{C14}$, $R^{C15}$, and $R^{C16}$ each independently represent a hydrogen atom, a halogen atom, an alkyl group having 1 to 20 carbon atoms, an alkoxy group having 1 to 20 carbon atoms, or an aryl group having 6 to 30 carbon atoms, and any adjacent two substituents may be bonded to each other to form a hydrocarbon ring structure; and n and m each independently represent 0, 1, or 2;

(CT2)

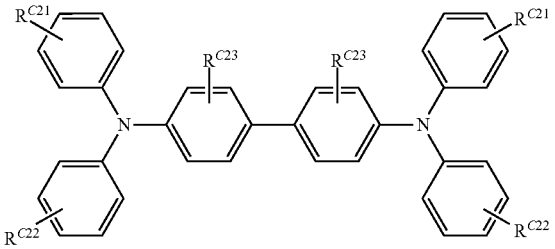

where, in Formula (CT2), $R^{C21}$, $R^{C22}$, and $R^{C23}$ each independently represent a hydrogen atom, a halogen atom, a hydroxyl group, a formyl group, an alkyl group, an alkoxy group, or an aryl group.

2. The electrophotographic photosensitive member according to claim 1, wherein, when the charge transporting materials are listed in order of decreasing HOMO energy levels, the difference in HOMO energy level between each adjacent two of the charge transporting materials is 0.01 eV or more and 0.2 eV or less.

3. The electrophotographic photosensitive member according to claim 2, the electrophotographic photosensitive member having an activation energy of 0.35 eV or less.

4. The electrophotographic photosensitive member according to claim 1, wherein the percent ratio A of the amount of each of the charge transporting materials to the total amount of the charge transporting materials satisfies a condition 2 below, $$[(100/N)-(100/N\times 0.2)]\%\leq A\leq[(100/N)+(100/N\times 0.2)]\% \quad \text{Condition 2}$$

where, in the condition 2, N represents the number of types of the charge transporting materials included in the top surface layer.

5. The electrophotographic photosensitive member according to claim 2, wherein the percent ratio A of the amount of each of the charge transporting materials to the total amount of the charge transporting materials satisfies a condition 2 below, $$[(100/N)-(100/N\times 0.2)]\%\leq A\leq[(100/N)+(100/N\times 0.2)]\% \quad \text{Condition 2}$$

where, in the condition 2, N represents the number of types of the charge transporting materials included in the top surface layer.

6. The electrophotographic photosensitive member according to claim 3, wherein the percent ratio A of the amount of each of the charge transporting materials to the total amount of the charge transporting materials satisfies a condition 2 below, $$[(100/N)-(100/N\times 0.2)]\%\leq A\leq[(100/N)+(100/N\times 0.2)]\% \quad \text{Condition 2}$$

where, in the condition 2, N represents the number of types of the charge transporting materials included in the top surface layer.

7. The electrophotographic photosensitive member according to claim 1, wherein a number of carboxyl groups included in the fluorine-containing resin particles is 0 or more and 30 or less per million carbon atoms.

8. The electrophotographic photosensitive member according to claim 2, wherein the number of carboxyl groups included in the fluorine-containing resin particles is 0 or more and 30 or less per million carbon atoms.

9. The electrophotographic photosensitive member according to claim 3, wherein the number of carboxyl groups included in the fluorine-containing resin particles is 0 or more and 30 or less per million carbon atoms.

10. The electrophotographic photosensitive member according to claim 4, wherein the number of carboxyl groups included in the fluorine-containing resin particles is 0 or more and 30 or less per million carbon atoms.

11. The electrophotographic photosensitive member according to claim 1, wherein an amount of the fluorine-containing dispersant is 0.25% by mass or more and 0.40% by mass or less of a total mass of the top surface layer.

12. The electrophotographic photosensitive member according to claim 2, wherein an amount of the fluorine-containing dispersant is 0.25% by mass or more and 0.40% by mass or less of a total mass of the top surface layer.

13. The electrophotographic photosensitive member according to claim 3, wherein an amount of the fluorine-containing dispersant is 0.25% by mass or more and 0.40% by mass or less of a total mass of the top surface layer.

14. The electrophotographic photosensitive member according to claim 4, wherein an amount of the fluorine-containing dispersant is 0.25% by mass or more and 0.40% by mass or less of a total mass of the top surface layer.

15. The electrophotographic photosensitive member according to claim 5, wherein an amount of the fluorine-containing dispersant is 0.25% by mass or more and 0.40% by mass or less of a total mass of the top surface layer.

16. The electrophotographic photosensitive member according to claim 1, wherein the amount of the charge transporting materials is 30% by mass or more and 60% by mass or less of a total mass of the top surface layer.

17. A process cartridge detachably attachable to an image forming apparatus, the process cartridge comprising:

the electrophotographic photosensitive member according to claim 1.

18. An image forming apparatus comprising:

the electrophotographic photosensitive member according to claim 1;

a charging unit that charges a surface of the electrophotographic photosensitive member;

an electrostatic latent image forming unit that forms an electrostatic latent image on the charged surface of the electrophotographic photosensitive member;

a developing unit that develops the electrostatic latent image formed on the surface of the electrophotographic photosensitive member with a developer including a toner in order to form a toner image; and a transfer unit that transfers the toner image onto a surface of a recording medium.

* * * * *